US011656015B2

(12) United States Patent
Sata et al.

(10) Patent No.: US 11,656,015 B2
(45) **Date of Patent: *May 23, 2023**

(54) REFRIGERATION CYCLE APPARATUS AND REFRIGERATION APPARATUS

(71) Applicant: Mitsubishi Electric Corporation, Tokyo (JP)

(72) Inventors: Hiroshi Sata, Tokyo (JP); Tomotaka Ishikawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 17 days.

This patent is subject to a terminal disclaimer.

(21) Appl. No.: 16/632,891

(22) PCT Filed: Sep. 14, 2017

(86) PCT No.: PCT/JP2017/033320

§ 371 (c)(1),
(2) Date: Jan. 22, 2020

(87) PCT Pub. No.: WO2019/053858

PCT Pub. Date: Mar. 21, 2019

(65) Prior Publication Data

US 2020/0200457 A1 Jun. 25, 2020

(51) Int. Cl.
*F25B 49/02* (2006.01)
*F25B 1/00* (2006.01)
*F25B 13/00* (2006.01)

(52) U.S. Cl.
CPC ..... *F25B 49/02* (2013.01); *F25B 1/00* (2013.01); *F25B 13/00* (2013.01);
(Continued)

(58) Field of Classification Search
CPC .. F25B 49/02; F25B 1/00; F25B 13/00; F25B 2313/0314; F25B 2600/2513;
(Continued)

(56) References Cited

U.S. PATENT DOCUMENTS

2015/0316316 A1* 11/2015 Oelfke ..... F25J 1/0022 62/611
2018/0363965 A1 12/2018 Hayamizu et al.
2019/0203995 A1* 7/2019 Ueda ..... F25B 49/02

FOREIGN PATENT DOCUMENTS

GB 2557837 A 6/2018
JP H09-105567 A 4/1997
(Continued)

OTHER PUBLICATIONS

Yamamura, Refrigerant Shortage Detection Device, Oct. 22, 2009, JP2009243784A, Whole Document (Year: 2009).*
(Continued)

*Primary Examiner* — Larry L Furdge
(74) *Attorney, Agent, or Firm* — Posz Law Group, PLC

(57) ABSTRACT

A refrigeration cycle apparatus is a refrigeration cycle apparatus having a refrigerant circuit having a compressor, a condenser, a supercooler, an expansion device, and an evaporator connected by a refrigerant pipe, and configured to circulate refrigerant containing refrigerant having a temperature gradient, wherein the supercooler sets a degree of supercooling of the refrigerant, which is a temperature difference between a temperature from the condenser to a refrigerant flow inlet of the supercooler and a temperature in a refrigerant flow outlet on a downstream side of the supercooler, to be larger than the temperature gradient generated at a time of refrigerant shortage of the refrigerant between the refrigerant flow inlet and the refrigerant flow outlet of the supercooler, the refrigeration cycle apparatus including a refrigerant amount determination unit configured to compare a determination threshold value set to a value larger than the temperature gradient of the refrigerant with the degree of supercooling of the refrigerant, and
(Continued)

determine whether or not there is a shortage of a refrigerant amount filled in the refrigerant circuit.

5 Claims, 8 Drawing Sheets

(52) U.S. Cl.
CPC ..... *F25B 2313/0314* (2013.01); *F25B 2600/2513* (2013.01); *F25B 2700/1931* (2013.01); *F25B 2700/21152* (2013.01)

(58) Field of Classification Search
CPC .... F25B 2700/1931; F25B 2700/21152; F25B 2700/2116; F25B 49/005; F25B 2500/24
See application file for complete search history.

(56) References Cited

FOREIGN PATENT DOCUMENTS

| | | | | | |
|---|---|---|---|---|---|
| JP | H09280699 | A | * | 10/1997 | |
| JP | 3207962 | B2 | | 9/2001 | |
| JP | 2001248919 | A | * | 9/2001 | |
| JP | 2008-025935 | A | | 2/2008 | |
| JP | 2008-057921 | A | | 3/2008 | |
| JP | 2009243784 | A | * | 10/2009 | |
| JP | WO-2018155513 | A1 | * | 8/2018 | ..... F25B 1/00 |
| WO | 2017/094059 | A1 | | 6/2017 | |
| WO | 2017/145826 | A1 | | 8/2017 | |
| WO | 2017/151488 | A1 | | 9/2017 | |

OTHER PUBLICATIONS

Watanabe et al., Replenishment Method of Refrigerant . . . Refrigerant Leakage Detector and Freezing Apparatus, Oct. 31, 1997, JPH09280699A, Whole Document (Year: 1997).*
Maeda et al, Refrigerant Quantity Management Device and Refrigerant Quantity Management System, May 8, 2017, WO2017094059A1, Whole Document (Year: 2017).*
Nakabo et al., Freezer, Apr. 22, 1997, JPH09105567A, Whole Document (Year: 1997).*
Aoyama et al., Refrigeration Cycle Apparatus and Hydronic Heater Including the Refrigeration Cycle Apparatus, Oct. 10, 2012, EP2508821A2, Whole Document (Year: 2012).*
Opteon xp41 Product Information, Opteon.com/en/products/refrigerants/xp41, No date, whole document.*
Maeda et al., Refrigerant Quantity Management Device and Refrigerant Quantity Management System, Jun. 8, 2017, WO2017094059A1, Whole Document (Year: 2017).*
Inoue et al., Air Conditioner, Sep. 14, 2001, JP2001248919A, Whole Document (Year: 2001).*
Enya, Composition Abnormality Detection Device and Composition Abnormality Detection Method, Aug. 30, 2018, WO2018155513A1, Whole Document (Year: 2018).*
International Search Report of the International Searching Authority dated Dec. 5, 2017 in corresponding International Patent Application No. PCT/JP2017/033320 (and English translation).
Extended European Search Report dated Sep. 2, 2020 issued in corresponding EP patent application No. 17924976.8.
Office Action dated Apr. 27, 2021 issued in corresponding JP patent application No. 2020-114557 (and English translation).
Office Action dated Feb. 9, 2022 issued in corresponding European patent application No. 17924976.8.

* cited by examiner

PROPER REFRIGERANT

REFRIGERANT SHORTAGE 1

REFRIGERANT SHORTAGE 2

REFRIGERATION CYCLE APPARATUS AND REFRIGERATION APPARATUS

CROSS REFERENCE TO RELATED APPLICATION

This application is a U.S. national stage application of PCT/JP2017/033320 filed on Sep. 14, 2017, the contents of which are incorporated herein by reference.

TECHNICAL FIELD

The present invention relates to a refrigeration cycle apparatus and a refrigeration apparatus. In particular, the present invention relates to determination of refrigerant shortage.

BACKGROUND ART

Examples of a refrigeration cycle apparatus having a refrigerant circuit include a refrigeration apparatus that refrigerates an object. In the refrigeration apparatus, generation of the excess or shortage of a refrigerant amount causes failure such as capacity deterioration of the refrigeration apparatus, and damage of components. Therefore, some refrigeration apparatuses include a function of determining the excess or shortage of an amount of refrigerant filled therein, to prevent the generation of such failure.

As a determination method of refrigerant shortage in a related-art refrigeration apparatus, for example, a temperature difference between a refrigerant temperature in a refrigerant flow inlet of a supercooler, and a refrigerant temperature in a refrigerant flow outlet of the supercooler is calculated. An apparatus configured to determine that refrigerant leakage occurs when it is determined that the temperature difference is reduced relative to a set value is proposed (for example, refer to Patent Literature 1).

CITATION LIST

Patent Literature

Patent Literature 1: Japanese Unexamined Patent Application Publication No. 09-105567

SUMMARY OF INVENTION

Technical Problem

When refrigerant used in the refrigerant apparatus is refrigerant having a temperature gradient such as R4070, R448A, or R449A, for example, a temperature difference is generated between a gas saturation temperature and a liquid saturation temperature even at the same pressure. Therefore, in a case of the refrigerant having the temperature gradient, also when there is a shortage of the refrigerant, a temperature difference between the temperature of the refrigerant at an inlet side of the supercooler, and the temperature of the refrigerant at a refrigerant flow outlet side is generated. When control is performed without consideration of the temperature gradient of the refrigerant, it is not possible to distinguish between a temperature difference generated by refrigerant shortage, and a temperature difference generated by the temperature gradient of the refrigerant, and there is a possibility that a judgment is made that the refrigerant is supercooled and the refrigerant shortage does not occur, even in the refrigerant shortage.

The present invention has been made in view of the aforementioned problem, and an object of the present invention is to obtain a refrigeration cycle apparatus and a refrigeration apparatus capable of accurately determining refrigerant shortage.

Solution to Problem

A refrigeration cycle apparatus according to one embodiment of the present invention is a refrigeration cycle apparatus comprising a refrigerant circuit in which a compressor, a condenser, a supercooler, an expansion device, and an evaporator are connected by a refrigerant pipe, and configured to circulate refrigerant containing refrigerant having a temperature gradient, wherein the supercooler sets a degree of supercooling of the refrigerant to be larger than the temperature gradient generated at a time of refrigerant shortage of the refrigerant between the refrigerant flow inlet and the refrigerant flow outlet of the supercooler, the degree of supercooling being a temperature difference between a temperature from the condenser to a refrigerant flow inlet of the supercooler and a temperature in a refrigerant flow outlet on a downstream side of the supercooler, the refrigeration cycle apparatus further comprising: a refrigerant amount determination unit configured to compare a determination threshold value set to a value larger than the temperature gradient of the refrigerant with the degree of supercooling of the refrigerant, and determine whether or not there is a shortage of a refrigerant amount filled in the refrigerant circuit.

Advantageous Effects of Invention

According to the refrigeration cycle apparatus according to one embodiment of the present invention, even when refrigerant having a temperature gradient is used, the degree of supercooling of the refrigerant in the supercooler is larger than the temperature gradient of the refrigerant, the refrigerant amount determination unit compares the determination threshold value set to the value larger than the temperature gradient of the refrigerant with the degree of supercooling of the refrigerant, and determines whether or not there is a shortage of the refrigerant amount, and therefore a control unit can make a determination by distinguishing the degree of supercooling of the refrigerant from the temperature difference by the refrigerant shortage to more accurately determine the refrigerant shortage.

DESCRIPTION OF EMBODIMENTS

Figure 1:
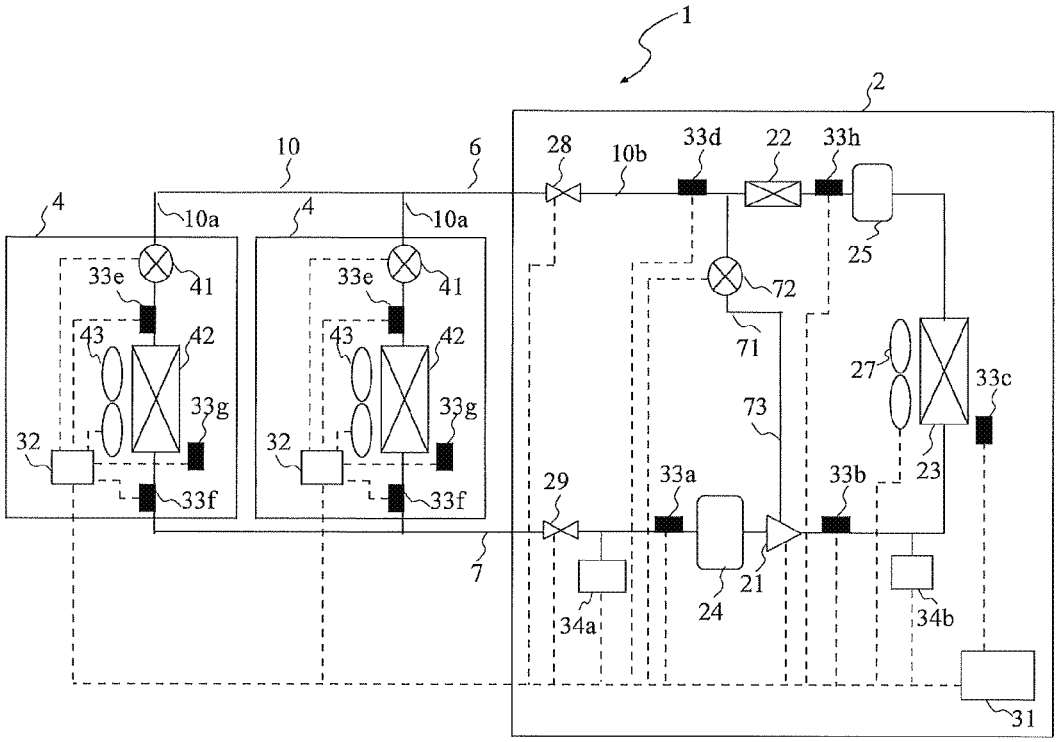
FIG. 1 is a diagram illustrating a configuration of a refrigeration apparatus 1 according to Embodiment 1 of the present invention.

Embodiments of the present invention will be described hereinafter with reference to the drawings. Herein, in the following drawings, components denoted by the same reference numerals are the same as or are equivalent to each other, and are common in the entire text of the embodiments described below. Forms of components described in the entire text of the specification are merely examples, and are not restrictive. Particularly, combination of the components is not limited only to combination of the respective embodiments, and components described in other embodiments can be appropriately applied to other embodiment. Whether a temperature, pressure, and other values are high or low is not particularly determined by relation of absolute values, but relatively determined by a state or operation of a system, an apparatus, or other apparatuses. Additionally, a plurality of the same types of apparatuses and other apparatuses distinguished by subscripts are often particularly distinguished, or when the plurality of the same types of apparatuses and other apparatuses do not need to be identified, subscripts are often omitted.

Embodiment 1

[Refrigeration Apparatus 1]

FIG. 1 is a diagram illustrating a configuration of a refrigeration apparatus 1 according to Embodiment 1 of the present invention. The refrigeration apparatus 1 illustrated in FIG. 1 is a refrigeration cycle apparatus that performs a vapor compression refrigeration cycle operation. Herein, the refrigeration apparatus 1 will be described as an example of the refrigeration cycle apparatus.

The refrigeration apparatus 1 cools the inside of a room as a space to be cooled, such as a room, a warehouse, a showcase, and a refrigerator. The refrigeration apparatus 1 includes, for example, a single heat source side unit 2, and two use side units 4 connected in parallel to the heat source side unit 2. Herein, as illustrated in FIG. 1, the refrigeration apparatus 1 of Embodiment 1 has the single heat source side unit 2, and the two use side units 4. However, the number of these units is not limited. For example, the number of the heat source side units 2 may be two or more. The number of the use side units 4 may be one, or three or more. When plural heat source side units 2 are present, the plurality of the heat source side units 2 may have the same capacity, or may have different capacity.

In the refrigeration apparatus 1, the heat source side unit 2 and the use side units 4 are connected by a liquid refrigerant extension pipe 6 and a gas refrigerant extension pipe 7, so that a refrigerant circuit 10 that circulates refrigerant is configured. In the refrigeration apparatus 1 of Embodiment 1, refrigerant filled in the refrigerant circuit 10 is refrigerant having a large temperature gradient. In the following description, the refrigeration apparatus 1 that exchanges heat between refrigerant and air will be described. However, this is not restrictive. For example, the refrigeration apparatus 1 that exchanges heat between fluid such as water, refrigerant, and brine, and refrigerant may be employed.

Herein, refrigerant, in which a difference (temperature gradient) between the saturated gas temperature and the saturated liquid temperature at the same pressure is 1K or more, is defined as refrigerant having a large temperature gradient. An average value of the saturated gas temperature and the saturated liquid temperature at the same pressure is defined as a saturation temperature average value. The saturation temperature average value is a range of 0 to 70 [degrees C.], and in refrigerant R404A and refrigerant R410A, the temperature gradient is less than 1.0 K. Therefore, each of the above-mentioned refrigerants is defined as refrigerant having a small temperature gradient. On the other hand, in refrigerant such as R407C, R448A, and R449A, the temperature gradient is 3.0 K or more. Therefore, each of the above-mentioned refrigerants is defined as refrigerant having a large temperature gradient.

Examples include mixed refrigerant of R32, R125, R134a, R1234yf and $CO_2$. At this time, a ratio XR32 (wt %) of the weight of R32 to the total weight of the mixed refrigerant is $33<XR32<39$ (Condition 1). Additionally, a ratio XR125 (wt %) of the weight of R125 to the total weight of the mixed refrigerant is $27<XR125<33$ (Condition 2). Furthermore, a ratio XR134a (wt %) of the weight of R134a to the total weight of the mixed refrigerant is $11<XR134a<17$ (Condition 3). A ratio XR1234yf (wt %) of the weight of R1234yf to the total weight of the mixed refrigerant is $11<XR1234yf<17$ (Condition 4). A ratio $XCO_2$ (wt %) of the weight of $CO_2$ to the total weight of the mixed refrigerant is $3<XCO_2<9$ (Condition 5). A total sum of XR32, XR125, XR134a, XR1234yf and $XCO_2$ is set to 100 (Condition 6). Mixed refrigerant that satisfies all of the above Condition 1 to Condition 6 is also refrigerant having a large temperature gradient."

[Use Side Unit]

The use side units 4 each are a unit installed in the inside of a room as space to be cooled, for example. Each use side unit 4 includes a use side refrigerant circuit 10*a* that serves as a part of the refrigerant circuit 10, a use side fan 43, and a use side control unit 32.

Each use side refrigerant circuit 10*a* has a use side expansion valve 41 and a use side heat exchanger 42. Each use side expansion valve 41 adjusts a flow rate of refrigerant that flows in the use side refrigerant circuit 10*a*. Each use side expansion valve 41 is composed of an expansion device such as an electronic expansion valve, and an automatic thermostatic expansion valve. Herein, each use side expansion valve 41 is installed in the use side unit 4 in Embodiment 1, but may be disposed in the heat source side unit 2. When the use side expansion valve 41 is in the heat source side unit 2, the use side expansion valve 41 is disposed between, for example, a first supercooler 22 and a liquid side shut-off valve 28 of the heat source side unit 2.

Each use side heat exchanger 42 functions as an evaporator that evaporates refrigerant by heat exchange with indoor air. The use side heat exchanger 42 is, for example, a fin and tube type heat exchanger having a plurality of heat transfer tubes and a plurality of fins.

Each use side fan 43 is an air-sending device that sends air to the use side heat exchanger 42. The use side fan 43 is disposed near the use side heat exchanger 42. The use side fan 43 includes, for example, a centrifugal fan, a multiblade fan or other fans. The use side fan 43 is driven by a motor (not illustrated). Herein, the rotation speed of the motor is controlled, so that the use side fan 43 can adjust an amount of air blown to the use side heat exchanger 42.

[Heat Source Side Unit]

The heat source side unit 2 is a unit that supplies heat to the use side units 4. The heat source side unit 2 has, for example, a heat source side refrigerant circuit 10*b* that serves as a part of the refrigerant circuit 10, a first injection flow passage 71, and a heat source side control unit 31.

The heat source side refrigerant circuit 10*b* has a compressor 21, a heat source side heat exchanger 23, a liquid receiver 25, the first supercooler 22, the liquid side shut-off valve 28, a gas side shut-off valve 29, and an accumulator 24. The compressor 21 is, for example, an inverter compressor that has an inverter circuit, and performs inverter control. Therefore, the compressor 21 can arbitrarily change an operation frequency, and change capacity (an amount of refrigerant fed per unit time). Herein, the compressor 21 may be a constant speed compressor that operates at 50 Hz or 60 Hz. In Embodiment 1, as illustrated in FIG. 1, an example in which a single compressor 21 is provided will be described. However, the two or more compressors 21 may be connected in parallel in accordance with magnitude of a load of each use side unit 4. The compressor 21 has an injection port. Therefore, refrigerant can be allowed to flow in a middle pressure part of the compressor 21.

The heat source side heat exchanger 23 functions as a condenser that condenses refrigerant by heat exchange with outdoor air. The heat source side heat exchanger 23 is, for example, a fin and tube type heat exchanger having a plurality of heat transfer tubes and a plurality of fins.

The heat source side fan 27 is an air-sending device that sends air to the heat source side heat exchanger 23. The heat source side fan 27 is disposed near the heat source side heat exchanger 23. The heat source side fan 27 includes, for example, a centrifugal fan, a multiblade fan or other fan. The heat source side fan 27 is driven by a motor (not illustrated). Herein, the rotation speed of the motor is controlled, so that the heat source side fan 27 can adjust an air blowing amount to the heat source side heat exchanger 23.

The liquid receiver 25 is, for example, a container that stores surplus liquid refrigerant. The liquid receiver 25 is disposed between the heat source side heat exchanger 23 and the first supercooler 22. Herein, the surplus liquid refrigerant is generated in the refrigerant circuit 10 in accordance with magnitude of the load of each use side unit 4, the condensing temperature of refrigerant, an outdoor air temperature that is an outdoor temperature, and the capacity of the compressor 21, for example.

The first supercooler 22 exchanges heat between the refrigerant and the outdoor air. In the refrigeration apparatus 1 of Embodiment 1, the first supercooler 22 is integrally formed with the heat source side heat exchanger 23. Therefore, in the refrigeration apparatus 1 of Embodiment 1, a part of the heat exchanger is configured as the heat source side heat exchanger 23, and other part of the heat exchanger is configured as the first supercooler 22. The first supercooler 22 is equivalent to a "supercooler" in the present invention. Herein, the first supercooler 22 and the heat source side heat exchanger 23 may be separately configured. In this case, a fan (not illustrated) that sends air to the first supercooler 22 is disposed near the first supercooler 22.

The liquid side shut-off valve 28 and the gas side shut-off valve 29 each have, for example, a valve that operates opening and closing, such as a ball valve, an on-off valve, and an operation valve. For example, when the refrigeration apparatus 1 is not operated, the liquid side shut-off valve 28 and the gas side shut-off valve 29 close the valves and shut off inflow and outflow of the refrigerant with the use side units 4.

The first injection flow passage 71 has an injection amount regulating valve 72 and an injection pipe 73. The injection pipe 73 has an end thereof being connected between the refrigerant flow outlet of the first supercooler 22 and the liquid side shut-off valve 28. The injection pipe 73 has the other end thereof being connected to an injection port of the compressor 21. The injection pipe 73 is a pipe that branches from the heat source side refrigerant circuit 10*b*, and allows a part of refrigerant sent from the heat source side heat exchanger 23 side to the use side heat exchanger 42 side to flow into the middle pressure part of the compressor 21. The injection amount regulating valve 72 adjusts the amount and the pressure of refrigerant that flows in the injection pipe 73.

Herein, in FIG. 1, an end of the injection pipe 73 as a refrigerant flow inlet of the first injection flow passage 71 is connected between the first supercooler 22 and the liquid side shut-off valve 28. However, for example, the end of the injection pipe 73 may be connected between the liquid receiver 25 and the first supercooler 22. Additionally, the end of the injection pipe 73 may be connected to the liquid receiver 25. Furthermore, the end of the injection pipe 73 may be connected to a part between the heat source side heat exchanger 23 and the liquid receiver 25.

[Control System Apparatus and Sensors]

Now, a control system apparatus and sensors provided in the refrigeration apparatus 1 of Embodiment 1 will be described. The heat source side unit 2 includes the heat source side control unit 31 that controls the entire refrigeration apparatus 1. The heat source side control unit 31 includes, for example, a microcomputer, a memory, and other devices. The use side units 4 each include the use side control unit 32 that controls the use side unit 4. Each use side control unit 32 also includes, for example, a microcomputer, a memory, and other devices. Each use side control unit 32 and the heat source side control unit 31 can perform communication to send and receive a control signal. For example, each use side control unit 32 controls the corresponding use side unit 4 in accordance with an instruction from the heat source side control unit 31.

In the refrigeration apparatus 1 according to Embodiment 1, the heat source side unit 2 has a suction temperature sensor 33*a*, a discharge temperature sensor 33*b*, a suction outdoor air temperature sensor 33*c*, a liquid receiver outlet temperature sensor 33*h*, and a supercooler outlet temperature sensor 33*d*. The heat source side unit 2 has a suction pressure sensor 34*a* and a discharge pressure sensor 34*b*. Each use side unit 4 has a use side heat exchange inlet temperature sensor 33*e*, a use side heat exchange outlet temperature sensor 33*f*, and a suction air temperature sensor 33*g*. The suction temperature sensor 33*a*, the discharge temperature sensor 33*b*, the suction outdoor air temperature sensor 33*c*, the liquid receiver outlet temperature sensor 33*h*, the supercooler outlet temperature sensor 33*d*, the suction pressure sensor 34*a*, and the discharge pressure sensor 34*b* are connected to the heat source side control unit 31. The use side heat exchange inlet temperature sensor 33*e*, the use side heat exchange outlet temperature sensor 33*f*, and the suction air temperature sensor 33*g* are connected to the use side control unit 32.

The suction temperature sensor 33*a* detects the temperature of refrigerant suctioned by the compressor 21. The discharge temperature sensor 33*b* detects the temperature of refrigerant discharged from the compressor 21. The liquid receiver outlet temperature sensor 33*h* detects the refrigerant temperature in the refrigerant flow outlet of the liquid receiver 25. Herein, the refrigerant temperature in the refrigerant flow outlet of the liquid receiver 25 is the temperature of refrigerant that passes through the heat source side heat exchanger 23. Additionally, the refrigerant temperature in the refrigerant flow outlet of the liquid receiver 25 is the temperature of refrigerant on the refrigerant flow inlet side of the first supercooler 22. Therefore, the liquid receiver outlet temperature sensor 33*h* also serves as a supercooler inlet temperature sensor. The supercooler outlet temperature sensor 33*d* detects the temperature of refrigerant that passes through the first supercooler 22. Each use side heat exchange inlet temperature sensor 33*e* detects the temperature of two-phase gas-liquid refrigerant that flows into the use side heat exchanger 42. Each use side heat exchange outlet temperature sensor 33*f* detects the temperature of the refrigerant that flows out of the use side heat exchanger 42. Herein, each of the aforementioned sensors that detects the temperature of the refrigerant is disposed to be brought into contact with a refrigerant pipe or to be inserted into the refrigerant pipe, and detects the temperature of the refrigerant, for example.

Each suction outdoor air temperature sensor 33*c* detects the temperature of air that has not yet passed through the heat source side heat exchanger 23, so that an outdoor ambient temperature is detected. Each suction air temperature sensor 33*g* detects the temperature of air that has not yet passed through the use side heat exchanger 42, so that an ambient temperature in a room where the use side heat exchanger 42 is installed is detected.

The suction pressure sensor 34*a* is disposed on the suction side of the compressor 21, and the pressure of refrigerant suctioned by the compressor 21 is detected. Herein, the suction pressure sensor 34*a* only needs to be disposed between the gas side shut-off valve 29 and the compressor 21. The discharge pressure sensor 34*b* is disposed on the discharge side of the compressor 21, and detects the pressure of refrigerant discharged by the compressor 21.

In Embodiment 1, the condensing temperature of the heat source side heat exchanger 23 can be obtained by converting the pressure of the discharge pressure sensor 34*b* into the saturation temperature. However, the condensing temperature of the heat source side heat exchanger 23 can also be acquired by regarding, as the condensing temperature, the temperature detected by the liquid receiver outlet temperature sensor 33*h* installed in the refrigerant flow outlet of the liquid receiver 25.

Figure 2:
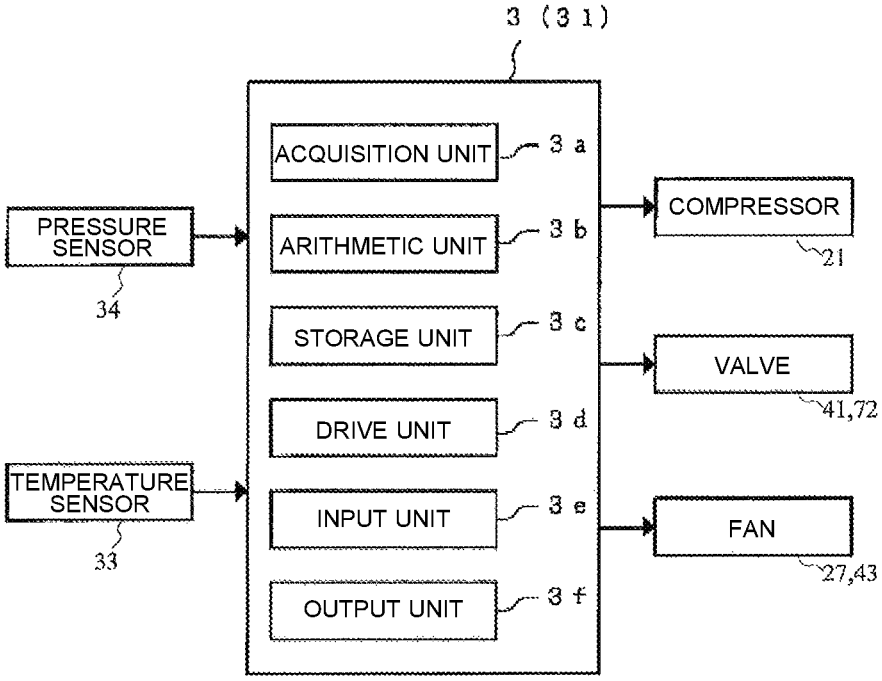
FIG. 2 is a diagram schematically illustrating an example of a configuration related to a control unit 3 that controls the refrigeration apparatus 1 according to Embodiment 1 of the present invention.

FIG. 2 is a diagram schematically illustrating an example of a configuration related to a control unit 3 that controls the refrigeration apparatus 1 according to Embodiment 1 of the present invention. The control unit 3 controls the entire refrigeration apparatus 1. The control unit 3 in Embodiment 1 is included in the heat source side control unit 31 in FIG. 1. Herein, the control unit 3 is equivalent to a refrigerant amount determination unit and a control unit of the present invention.

An acquisition unit 3*a* acquires the temperature, the pressure and other values detected by the sensors as data on the basis of signals from the sensors such as the pressure sensor and the temperature sensor. An arithmetic unit 3*b* performs a process such as arithmetic operation, comparison and determination by using the data acquired by the acquisition unit 3*a*. A drive unit 3*d* controls driving of apparatuses such as the compressor 21, the valves, and the fan by using a result calculated by the arithmetic unit 3*b*. A storage unit 3*c* stores, for example, physical property values (such as saturation pressure and a saturation temperature), of refrigerant, data for arithmetic operation by the arithmetic unit 3*b*, and other data. The arithmetic unit 3*b* can refer or update the contents of the data stored in the storage unit 3*c* as necessary.

The control unit 3 includes an input unit 3*e* and an output unit 3*f*. The input unit 3*e* processes a signal related to operation input from a remote control, switches (not illustrated), or other input means, or processes a signal of communication data sent from a communication unit (not illustrated) such as a telephone line and a LAN. The output unit 3*f* outputs a processing result of the control unit 3 to a display unit (not illustrated) such as an LED, and a monitor, outputs the processing result to a notification unit (not illustrated) such as a speaker, or outputs the processing result to a communication unit (not illustrated) such as a telephone line and a LAN. Herein, when a signal including data is output to a remote location by the communication unit, communication units (not illustrated) having the same communication protocol may be provided in both the refrigeration apparatus 1 and a remote device (not illustrated).

Herein, the control unit 3 has a microcomputer as described above. The microcomputer has, for example, a control arithmetic processing device such as a central processing unit (CPU). The control arithmetic processing device implements functions of the acquisition unit 3*a*, the arithmetic unit 3*b*, and the drive unit 3*d*. Additionally, the control unit 3 has an I/O port that manages output/input. The I/O port implements functions of the input unit 3*e* and the output unit 3*f*. Additionally, the control unit 3 has, for example, a volatile storage device (not illustrated) such as a random access memory (RAM), and a hard disk that are capable of temporarily storing data, and a nonvolatile auxiliary storage device (not illustrated) such as a flash memory capable of storing data for a long period. These storage devices each implement a function of the storage unit 3*c*. For example, the storage device has data obtained by programming a process procedure performed by the control arithmetic processing device. The control arithmetic processing device performs a process on the basis of the data of the program, and implements functions of the acquisition unit 3*a*, the arithmetic unit 3*b*, and the drive unit 3*d*. However, this is not restrictive, and each unit may be composed of a dedicated device (hardware).

Herein, for example, a shortage of a refrigerant amount can be determined by use of the refrigeration apparatus 1 and the remote device (not illustrated). In this case, for example, the arithmetic unit 3*b* calculates the temperature efficiency T of the first supercooler 22 by use of data acquired by the acquisition unit 3*a*. Then, the output unit 3*f* transmits, to the remote device, a signal including data of the temperature efficiency T calculated by the arithmetic unit 3*b*. The remote device includes, for example, a refrigerant shortage determination unit (not illustrated) that determines a shortage of a refrigerant amount, and determines the shortage of the refrigerant amount by using the temperature efficiency T. Refrigerant shortage information and other information are managed by the remote device, so that states such as abnormality of the refrigeration apparatus 1 can be early discovered at a place where the remote device is installed. Therefore, when abnormality occurs in the refrigeration apparatus 1, it is possible to perform maintenance, for example, of the refrigeration apparatus 1.

Herein, in the aforementioned description, an example in which the control unit 3 is included in the heat source side control unit 31 is described. However, it is not restrictive. For example, the control unit 3 may be included in each use side control unit 32. The control unit 3 may be configured as a device different from the heat source side control unit 31 and the use side control units 32.

[Operation of Refrigeration Apparatus 1 (Case where Refrigerant Amount is Proper)]

Figure 3:
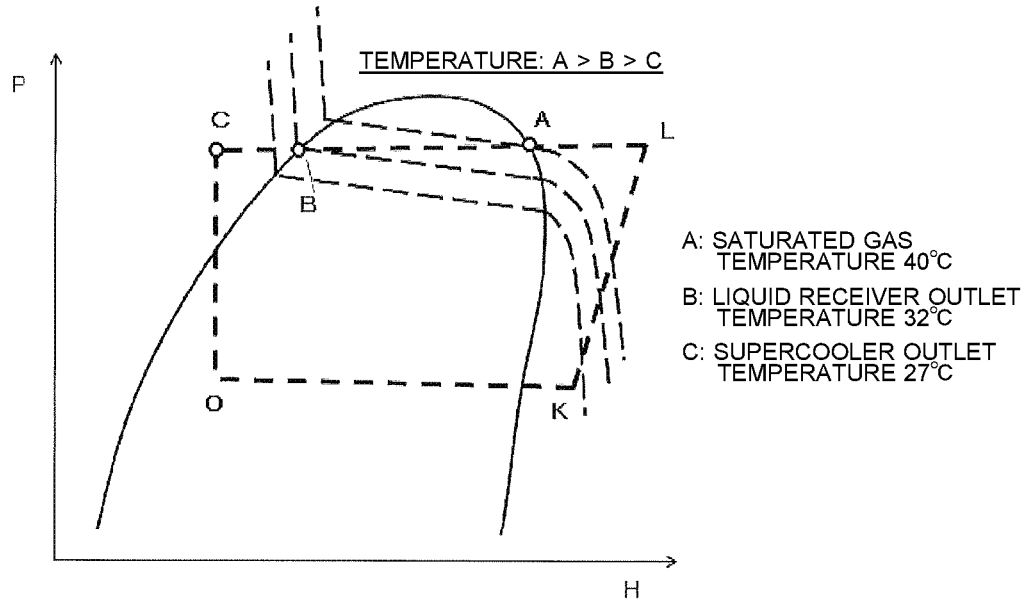
FIG. 3 is a diagram illustrating an example of a p-h diagram when a refrigerant amount in a refrigerant circuit 10 of the refrigeration apparatus 1 according to Embodiment 1 of the present invention is proper.

FIG. 3 is a diagram illustrating an example of a p-h diagram when a refrigerant amount in the refrigerant circuit 10 of the refrigeration apparatus 1 according to Embodiment 1 of the present invention is proper. Herein, operation of the refrigeration apparatus 1 in the case of the proper refrigerant amount in the refrigerant circuit 10 will be first described. The compressor 21 illustrated in FIG. 1 compresses refrigerant. At this time, the refrigerant is changed from a state of a position of a point K of the suction side of the compressor 21 of FIG. 3 to a state of a position of a point L of the discharge side of the compressor 21. High-temperature and high-pressure gas refrigerant compressed by the compressor 21 illustrated in FIG. 1 is heat-exchanged by the heat source side heat exchanger 23 functioning as a condenser, and is condensed and liquefied. At this time, the refrigerant is changed from the state of the position of the point L of the discharge side of the compressor 21 of FIG. 3 to a state of a position of a point B of the refrigerant flow outlet side of the liquid receiver 25 through a position of a point A of the inlet side of the heat source side heat exchanger 23. Herein, the refrigerant that is heat-exchanged by the heat source side heat exchanger 23 and condensed and liquefied flows into the liquid receiver 25, and is temporarily stored in the liquid receiver 25. An amount of the refrigerant stored in the liquid receiver 25 is changed in accordance with the operation load of each use side unit 4, an outdoor air temperature, a condensing temperature, or other factors.

The liquid refrigerant that flows out of the liquid receiver 25 of FIG. 1 is supercooled by the first supercooler 22. At this time, the refrigerant is changed from the state of the position of the point B of the refrigerant flow outlet side of the liquid receiver 25 of FIG. 3 to the state of the position of the point C of the refrigerant flow outlet side of the first supercooler 22. Herein, a temperature obtained by deducting a temperature in the supercooler outlet temperature sensor 33*d* from a temperature in the liquid receiver outlet temperature sensor 33*h* is the degree SC of supercooling in the refrigerant flow outlet of the first supercooler 22. In the example of FIG. 3, the saturated gas temperature based on pressure detected by the discharge pressure sensor 34*b* is 40 [degrees C.]. The liquid receiver outlet temperature that is a temperature in the refrigerant flow outlet of the liquid receiver 25 is 32 [degrees C.]. Furthermore, a supercooler outlet temperature that is a temperature in the refrigerant flow outlet of the first supercooler 22 is 27 [degrees C.]. The degree SC of supercooling is 5 [K].

The liquid refrigerant supercooled by the first supercooler 22 of FIG. 1 flows into the use side units 4 through the liquid side shut-off valve 28 and the liquid refrigerant extension pipe 6. Then, the refrigerant that flows into each use side unit 4 is decompressed by the use side expansion valve 41, and is turned to be low pressure two-phase gas-liquid refrigerant. At this time, the refrigerant is changed from the state of the position of the point C of the refrigerant flow outlet side of the first supercooler 22 of FIG. 3 to a state of a position of a point O at which the refrigerant passes the use side expansion valve 41.

The two-phase gas-liquid refrigerant decompressed by each use side expansion valve 41 of FIG. 1 flows into the corresponding use side heat exchanger 42 functioning as an evaporator, evaporates, and is turned to be gas refrigerant. At this time, the refrigerant is changed from the state of the position of the point O at which the refrigerant passes the use side expansion valve 41 of FIG. 3 to a state of a position of a point K at which the refrigerant passes the suction side of the compressor 21 (refrigerant flow outlet side of the use side heat exchanger 42). Then, the refrigerant cools indoor air. Herein, a temperature obtained by deducting a refrigerant evaporating temperature detected by each use side heat exchange inlet temperature sensor 33*e* from a temperature detected by the corresponding use side heat exchange outlet temperature sensor 33*f* is the degree of superheat of the refrigerant that flows out of the corresponding use side heat exchanger 42.

The gas refrigerant evaporated by each use side heat exchanger 42 and gasified flows into the heat source side unit 2 through the gas refrigerant extension pipe 7. The refrigerant that flows into the heat source side unit 2 returns to the compressor 21 through the gas side shut-off valve 29 and the accumulator 24.

Now, injection using the first injection flow passage 71 will be described. The injection in the refrigeration apparatus 1 of Embodiment 1 is that refrigerant flows in through the first injection flow passage 71. The discharge temperature of refrigerant discharged from the compressor 21 can be reduced by performing the injection. When the injection is performed, the injection amount regulating valve 72 decompresses a part of high pressure liquid refrigerant supercooled by the first supercooler 22. The decompressed refrigerant is turned to be medium pressure two-phase refrigerant, and flows into the middle pressure part of the compressor 21.

[Operation of Refrigeration Apparatus (Case of Shortage of Refrigerant Amount)]

Figure 4:
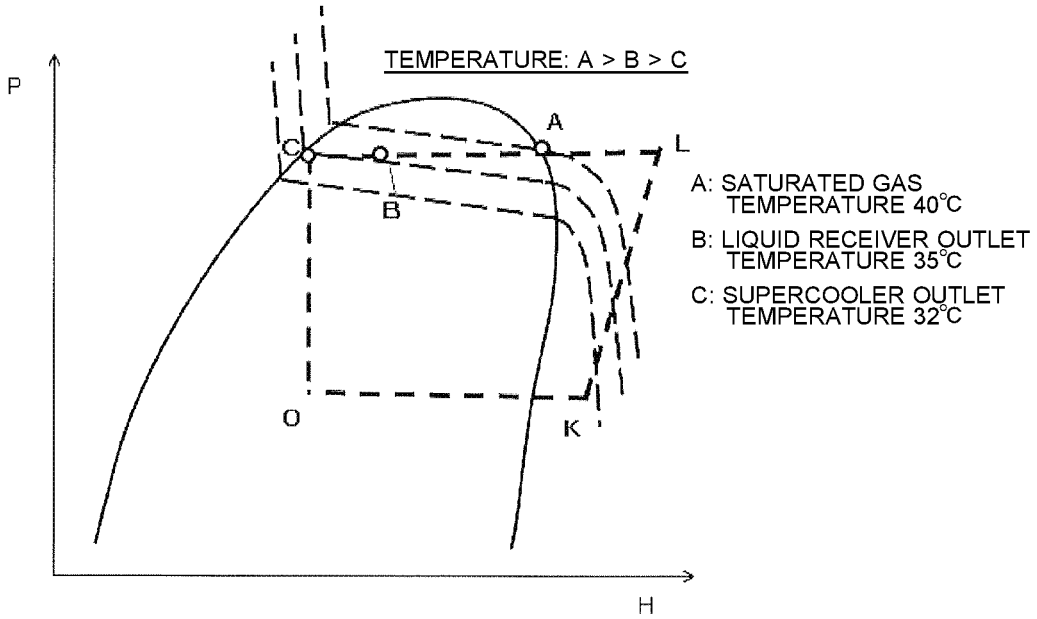
FIG. 4 is a diagram illustrating an example of a p-h diagram when there is a shortage of the refrigerant amount in the refrigerant circuit 10 of the refrigeration apparatus 1 according to Embodiment 1 of the present invention.

FIG. 4 is a diagram illustrating an example of a p-h diagram when there is a shortage of the refrigerant amount in the refrigerant circuit 10 of the refrigeration apparatus 1 according to Embodiment 1 of the present invention. A state of a shortage of a refrigerant amount illustrated in FIG. 4 is defined as a refrigerant shortage 1. For example, refrigerant leaks from the refrigeration apparatus 1 illustrated in FIG. 1, and an amount of the refrigerant in the refrigerant circuit 10 is reduced. Herein, while surplus liquid refrigerant is stored in the liquid receiver 25, the surplus liquid refrigerant stored in the liquid receiver 25 is reduced. Therefore, while the surplus liquid refrigerant exists in the liquid receiver 25, the refrigeration apparatus 1 operates similarly to a case in which the refrigerant amount is proper, as illustrated in FIG. 3.

When the refrigerant is further reduced, and the surplus liquid refrigerant in the liquid receiver 25 is used up, an enthalpy at the position of the point B of the refrigerant flow outlet side of the liquid receiver 25 is increased as illustrated in FIG. 4. With increase of an enthalpy at the position of the point B of the refrigerant flow outlet side of the liquid receiver 25, the first supercooler 22 condenses and liquefies, and supercools two-phase refrigerant. Herein, as illustrated in FIG. 4, the refrigerant is changed from the state at the position of the point B of the refrigerant flow outlet side of the liquid receiver 25 to the state of the position of the point C of the refrigerant flow outlet side of the first supercooler 22. At this time, an enthalpy at the refrigerant flow outlet side of the first supercooler 22 is also increased. FIG. 4 illustrates a state in which the refrigerant is turned to be saturated liquid, the quality of which is turned to be 0, at the position of the point C of the refrigerant flow outlet side of the first supercooler 22.

In the example of FIG. 4, the saturated gas temperature based on pressure detected by the discharge pressure sensor 34*b* is 40 [degrees C.]. Additionally, the saturated liquid temperature is 32 [degrees C.]. Furthermore, the liquid receiver outlet temperature is 35 [degrees C.]. The supercooler outlet temperature is 32 [degrees C.]. At this time, the degree SC of supercooling is expressed by Expression (1) described below.

$$\text{Degree of Supercooling SC}=\text{Saturated Liquid Temperature 32 [degrees C.]}-\text{Supercooler Outlet Temperature 32 [degrees C.]}=0\ [\text{K}] \quad (1)$$

However, the temperature detected at the outlet side of the first supercooler 22 by the liquid receiver outlet temperature sensor 33*h* is 35 [degrees C.]. Additionally, the temperature detected by the supercooler outlet temperature sensor 33*d* is turned to be 32 [degrees C.]. The refrigerant has temperature gradient, and therefore the temperature difference is 3 [K]. This is a state of the refrigerant shortage 1. On the other hand, in a case of refrigerant having no temperature gradient, the temperature difference is 0 [K].

Figure 5:
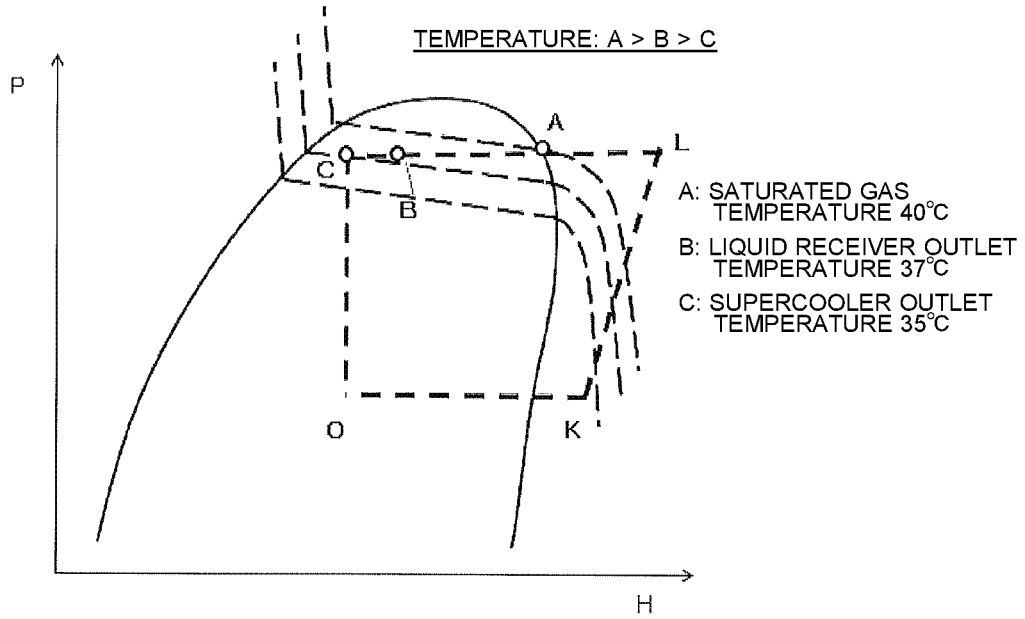
FIG. 5 is a diagram illustrating another example of the p-h diagram when there is a shortage of the refrigerant amount in the refrigerant circuit 10 of the refrigeration apparatus 1 according to Embodiment 1 of the present invention.

FIG. 5 is a diagram illustrating another example of the p-h diagram when there is a shortage of the refrigerant amount in the refrigerant circuit 10 of the refrigeration apparatus 1 according to Embodiment 1 of the present invention. A state of a shortage of a refrigerant amount illustrated in FIG. 5 is defined as a refrigerant shortage 2. When the refrigerant in the refrigerant circuit 10 is further reduced, an enthalpy of the refrigerant at the position of the point B on the refrigerant flow outlet side of the liquid receiver 25, and an enthalpy of the refrigerant at the position of the point C of the refrigerant flow outlet side of the first supercooler 22 are further increased. At this time, in the example of FIG. 5, the saturated gas temperature based on pressure detected by the discharge pressure sensor 34*b* is 40 [degrees C.]. Additionally, the saturated liquid temperature is 32 [degrees C.]. Furthermore, the liquid receiver outlet temperature is 37 [degrees C.]. The supercooler outlet temperature is 35 [degrees C.]. At this time, the degree SC of supercooling is expressed by Expression (2) described below. Herein, the degree SC of supercooling is −3 [K] on the expression. However, actually, there is no state that the degree SC of supercooling is −3 [K]. Therefore, Expression (2) expresses that refrigerant is not in a supercooling state.

$$\text{Degree of Supercooling SC}=\text{Saturated Liquid Temperature 32 [degrees C.]}-\text{Supercooler Outlet Temperature 35 [degrees C.]}=-3\ [\text{K}] \quad (2)$$

However, the temperature detected by the liquid receiver outlet temperature sensor 33*h* on the refrigerant flow outlet side of the first supercooler 22 is 37 [degrees C.]. Additionally, the temperature detected by the supercooler outlet temperature sensor 33*d* is 35 [degrees C.]. The refrigerant has temperature gradient, and therefore the temperature difference is 2 [K]. This is a state of the refrigerant shortage 2.

Figure 6:
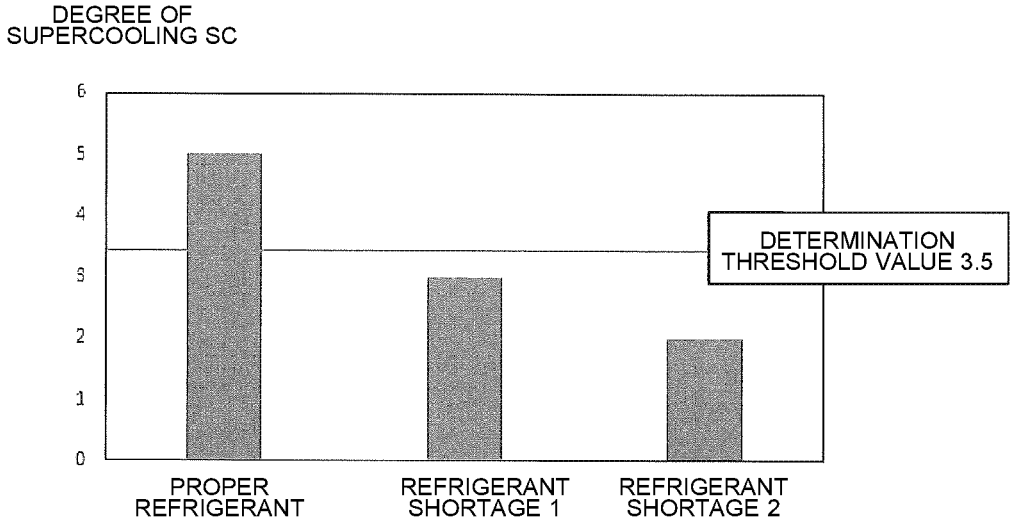
FIG. 6 is a diagram illustrating relation between the refrigerant in the refrigerant circuit 10 according to Embodiment 1 of the present invention, and a degree SC of supercooling.

FIG. 6 is a diagram illustrating relation between the refrigerant in the refrigerant circuit 10 according to Embodiment 1 of the present invention, and the degree SC of supercooling. In a case in which the refrigerant amount is determined by use of the degree SC of supercooling of the refrigerant, when the degree SC of supercooling is smaller than a predetermined determination threshold value, it is determined that there is a shortage of the refrigerant amount. When refrigerant having a large temperature gradient is used as in the refrigeration apparatus 1 of Embodiment 1, a determination threshold value is set to a value larger than the temperature gradient of refrigerant between a position of the refrigerant flow outlet side of the liquid receiver 25 and a position of the refrigerant flow outlet side of the first supercooler 22. For example, in the example of FIG. 6, the determination threshold value is set to 3.5 [K]. It is necessary to design such that the degree SC of supercooling in the first supercooler 22 is also larger than the temperature gradient in the first supercooler 22 from the refrigerant flow outlet of the liquid receiver 25. For example, in the refrigeration apparatus 1 of Embodiment 1, the apparatuses in the refrigerant circuit 10 are controlled such that the degree of supercooling is 5.0 [K].

[Refrigerant Amount Determination Process Operation]

Figure 7:
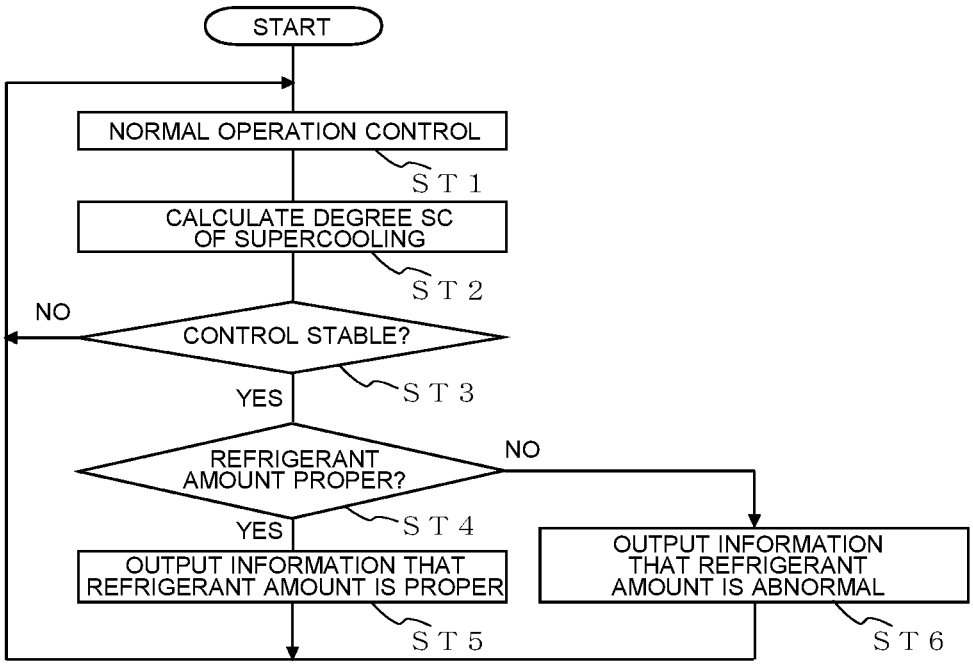
FIG. 7 is a diagram illustrating an example of a refrigerant amount determination process in the refrigeration apparatus 1 according to Embodiment 1 of the present invention.

FIG. 7 is a diagram illustrating an example of a refrigerant amount determination process in the refrigeration apparatus 1 according to Embodiment 1 of the present invention. In Embodiment 1, description will be made assuming that the heat source side control unit 31 performs a refrigerant amount determination process as a refrigerant amount determination processing unit. The refrigeration apparatus 1 of Embodiment 1 calculates the degree SC of supercooling of the first supercooler 22, and performs a refrigerant amount determination process as to whether or not there is a shortage of the refrigerant amount. Herein, the refrigerant amount determination process described in the following can be applied to refrigerant filling work performed when the refrigeration apparatus 1 is installed, or refrigerant filling work performed when maintenance of the refrigeration apparatus 1 is performed. Refrigerant amount determination operation may be performed, for example, when an instruction from the remote device (not illustrated) is received.

In Step ST1 of FIG. 7, the refrigeration apparatus 1 illustrated in FIG. 1 performs normal operation control. In the normal operation control by the refrigeration apparatus 1, the heat source side control unit 31 acquires operation data such as the pressure and the temperature in the refrigerant circuit 10, the pressure and the temperature detected by the sensors, for example. Then, the heat source side control unit 31 calculates a control value such as a target value and a deviation of the condensing temperature, the evaporating temperature, or other temperatures by using the operation data, and controls actuators such as the compressor 21. Hereinafter, operation of the actuators will be described.

For example, the heat source side control unit 31 controls the operation frequency of the compressor 21 such that the evaporating temperature in each use side heat exchanger 42 of the refrigeration apparatus 1 coincides with a target evaporating temperature. Herein, the target evaporating temperature is, for example, 0 [degrees C.]. The evaporating temperature of each use side heat exchanger 42 can also be obtained by converting the pressure detected by the suction pressure sensor 34*a* into the saturation temperature. For example, when the heat source side control unit 31 determines that a current evaporating temperature is higher than the target evaporating temperature, control of increasing the operation frequency of the compressor 21 is performed. When the heat source side control unit 31 determines that a current evaporating temperature is lower than the target evaporating temperature, control of reducing the operation frequency of the compressor 21 is performed.

For example, the heat source side control unit 31 controls the rotation speed of the heat source side fan 27 that sends air to the heat source side heat exchanger 23 such that the condensing temperature in the refrigeration cycle of the refrigeration apparatus 1 coincides with a target condensing temperature. Herein, the target condensing temperature is, for example, 45 [degrees C.]. The condensing temperature in the heat source side heat exchanger 23 of the refrigeration apparatus 1 can also be obtained by converting the pressure detected by the discharge pressure sensor 34*b* into the saturation temperature. For example, when determining that the current condensing temperature is higher than the target condensing temperature, the heat source side control unit 31 performs control of increasing the rotation speed of the heat source side fan 27. Additionally, when determining that the current condensing temperature is lower than the target condensing temperature, the heat source side control unit 31 performs control of reducing the rotation speed of the heat source side fan 27.

For example, the heat source side control unit 31 adjusts the opening degree of the injection amount regulating valve 72 of the first injection flow passage 71 by using signals sent from the various sensors. For example, when determining that the current discharge temperature in the compressor 21 is high, the heat source side control unit 31 controls such that the opening degree of the injection amount regulating valve 72 is increased. When determining that the current discharge temperature of the compressor 21 is low, the heat source side control unit 31 controls such that the opening degree of the injection amount regulating valve 72 is decreased. Then, for example, the heat source side control unit 31 controls the rotation speed of each use side fan 43 that sends air to the use side unit 4.

In Step ST2, the heat source side control unit 31 calculates the degree SC of supercooling by using, for example, the liquid receiver outlet temperature, and the supercooler outlet temperature.

In Step ST3, the heat source side control unit 31 determines whether the normal operation control performed by the refrigeration apparatus 1 in Step ST1 is stable. When the heat source side control unit 31 determines that the operation control by the refrigeration apparatus 1 is not stable, the process returns to Step ST1. On the other hand, when the heat source side control unit 31 determines that the operation control by the refrigeration apparatus 1 is stable, the process proceeds to Step ST4.

In Step ST4, the heat source side control unit 31 determines whether the refrigerant amount in the refrigerant circuit 10 is proper, by comparing a refrigerant amount determination parameter with a reference value thereof. Specifically, a deviation amount ΔSC (=SC−SCm) between the degree SC of supercooling at the refrigerant flow outlet of the first supercooler 22 and a determination threshold value SCm is obtained. Herein, the deviation amount ΔSC is defined as the refrigerant amount determination parameter. Then, it is determined whether or not the obtained deviation amount ΔSC is not less than a value of a set deviation amount (for example, 1.5 (=5.0-3.5)). When the heat source side control unit 31 determines that the deviation amount ΔSC is not less than the value of the set deviation amount, it is regarded that there is not a shortage of the refrigerant amount, and the process proceeds to Step ST5. When the heat source side control unit 31 determines that the deviation amount ΔSC is smaller than the set deviation amount, it is regarded that there is a shortage of the refrigerant amount, and the process proceeds to Step ST6.

At this time, as for the degree SC of supercooling of the first supercooler 22, it is desirable that a moving average of a plurality of temporally different degrees SC of supercooling be taken, compared to use of an instantaneous value calculated on the basis of a single detection. The determination based on the moving average of the plurality of temporally different degrees SC of supercooling is performed, so that stability in the refrigerant circuit 10 can be considered. Herein, the determination threshold value SCm may store, for example, data preset in the storage unit 3*c* of the heat source side control unit 31. Additionally, as the determination threshold value SCm, data input from the remote control, a switch, or other input means may be set. Furthermore, the data may be set as the determination threshold value SCm, depending on an instruction sent from the remote device (not illustrated).

When determining that a refrigerant amount determination result in Step ST4 is a proper refrigerant amount, the heat source side control unit 31 outputs information that the refrigerant amount is proper, in Step ST5. When the refrigerant amount is proper, the information that the refrigerant amount is proper is displayed on a display unit (not illustrated) such as an LED and a liquid crystal display provided in the refrigeration apparatus 1, for example. Additionally, for example, a signal indicating that the refrigerant amount is proper is transmitted to the remote device (not illustrated).

On the other hand, when determining that the refrigerant amount determination result in Step ST4 indicates a shortage of refrigerant amount, in Step ST6, the heat source side control unit 31 outputs information that the refrigerant amount is abnormal. When the refrigerant amount is abnormal, an alarm indicating that the refrigerant amount is abnormal is displayed on a display unit (not illustrated) such as an LED and a liquid crystal display disposed in the refrigeration apparatus 1, for example. Additionally, for example, a signal indicating that the refrigerant amount is abnormal is transmitted to the remote device (not illustrated). Herein, when the refrigerant amount is abnormal, urgent handling is often required, and therefore abnormality may be directly notified to a serviceman through a telephone line or other communication means.

Herein, after calculating the degree SC of supercooling in Step ST2, the heat source side control unit 31 determines whether or not determination of the refrigerant amount is performed in Step ST3. However, the heat source side control unit 31 may perform the process of Step ST2 after the process of Step ST3. After determining whether or not the determination of the refrigerant amount is performed, the degree SC of supercooling is calculated, so that it is possible to reduce a processing amount calculated by the heat source side control unit 31.

As described above, in the refrigeration apparatus 1 of Embodiment 1, the heat source side control unit 31 including the control unit 3 controls the apparatuses such as the compressor 21 such that the degree SC of supercooling of the first supercooler 22 is larger than temperature gradient generated between the refrigerant flow outlet of the liquid receiver 25 and the first supercooler 22. The refrigerant amount determination process of determining whether or not the refrigerant amount is proper is performed on the basis of comparison between the degree SC of supercooling in the first supercooler 22 and the determination threshold value SCm set to be larger than the temperature gradient generated between the refrigerant flow outlet of the liquid receiver 25 and the first supercooler 22. Therefore, even when refrigerant having a large temperature gradient is used in the refrigerant circuit 10, the heat source side control unit 31 can perform the refrigerant amount determination process highly precisely. This refrigerant amount determination process can be applied also to refrigerant having no temperature gradient or a small temperature gradient.

Furthermore, in the refrigeration apparatus 1 of Embodiment 1, the refrigerant amount determination process can be performed by use of the various temperature sensors, and therefore it is possible to perform the refrigerant amount determination process with an inexpensive configuration without requiring pressure sensor.

Herein, in the aforementioned operation control, control of specifying the condensing temperature and the evaporating temperature is not performed. However, for example, control of causing the condensing temperature and the evaporating temperature to be constant may be performed. For example, the operation frequency of the compressor 21 and the rotation speed of the heat source side fan 27 of the heat source side unit 2 are made constant values, and the condensing temperature and the evaporating temperature may not be controlled. For example, control of making one of the condensing temperature and the evaporating temperature is target temperature may be performed. Change of an operation state amount that changes in accordance with the degree SC of supercooling of the first supercooler 22 and the degree SC of supercooling is reduced by control of the operation state of the refrigeration apparatus 1 under constant conditions. Therefore, it is possible to easily determine the threshold value, and the refrigerant amount determination process is easily performed.

The refrigerant amount determination process of Embodiment 1 is applied to refrigerant filling work performed when the refrigeration apparatus 1 is installed, or refrigerant filling work performed when maintenance of the refrigeration apparatus 1 is performed, so that it is possible to implement reduction of time for refrigerant filling work, and load reduction of a worker.

Embodiment 2

Figure 8:
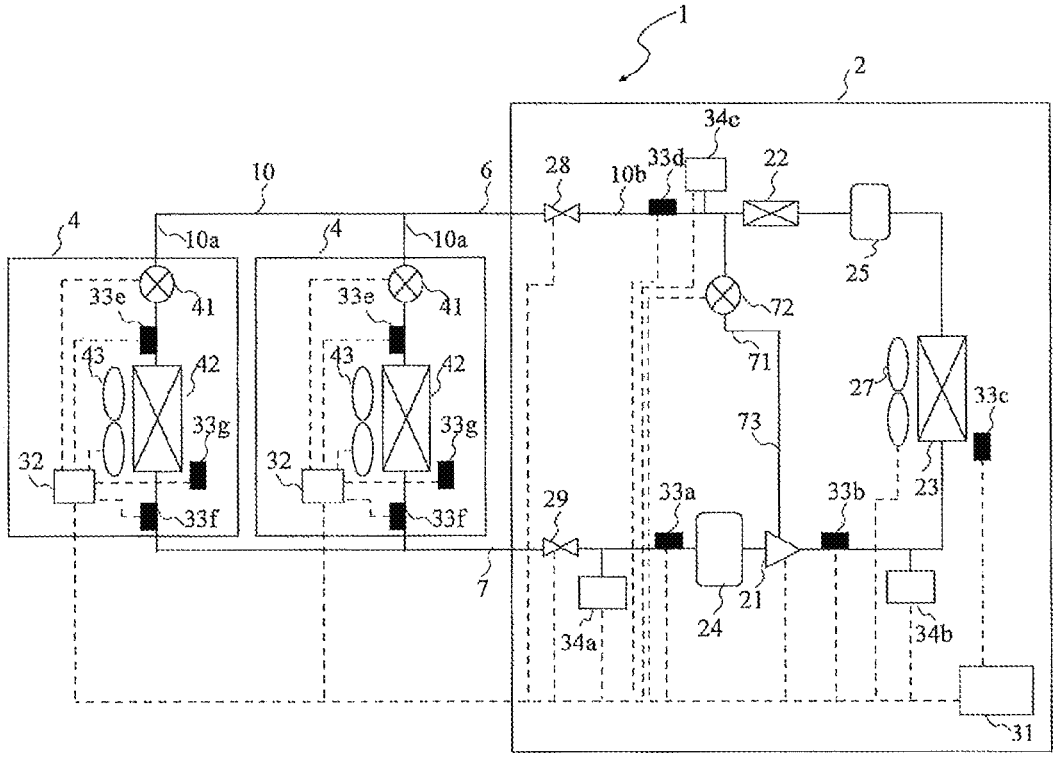
FIG. 8 is a diagram illustrating a configuration of a refrigeration apparatus 1 according to Embodiment 2 and Embodiment 4 of the present invention.

FIG. 8 is a diagram illustrating a configuration of a refrigeration apparatus 1 according to Embodiment 2 of the present invention. In FIG. 8, apparatuses denoted by the same reference numerals as the apparatuses in FIG. 1 perform operation similar to the operation described in Embodiment 1. In the refrigeration apparatus 1 of Embodiment 2, a supercooler outlet pressure sensor 34*c* detects the pressure of refrigerant that passes through a first supercooler 22. The supercooler outlet pressure sensor 34*c* is installed to detect the pressure of refrigerant at the same position as a supercooler outlet temperature sensor 33*d*, in place of the liquid receiver outlet temperature sensor 33*h* in Embodiment 1.

In Embodiment 1, the degree SC of supercooling was calculated, for example, on the basis of the liquid receiver outlet temperature detected by the liquid receiver outlet temperature sensor 33*h*. In Embodiment 2, a saturated liquid temperature is obtained from pressure detected by the supercooler outlet pressure sensor 34*c*. Then, a difference between the saturated liquid temperature and a temperature detected by the supercooler outlet temperature sensor 33*d* is defined as the degree SC of supercooling. The degree SC of supercooling is obtained on the basis of the pressure and the temperature of refrigerant at the same position, so that the temperature gradient of the refrigerant does not need to be considered.

Herein, a saturated liquid temperature in an installation position of the supercooler outlet temperature sensor 33*d* may be obtained on the basis of a saturated liquid temperature obtained from discharge pressure detected by the discharge pressure sensor 34*b*. Then, the difference between the saturated liquid temperature and the temperature detected by the supercooler outlet temperature sensor 33*d* is defined as the degree SC of supercooling. Therefore, the degree SC of supercooling can be obtained on the basis of the discharge pressure, and therefore it is possible to reduce the number of pressure sensors, and it is possible to attain cost reduction.

Herein, as to the saturation temperature obtained from the pressure at the same position as the supercooler outlet temperature sensor 33*d*, the saturation temperature being obtained at this time, the saturated liquid temperature obtained from the discharge pressure detected by the discharge pressure sensor 34*b*, and a temperature gradient in the first supercooler 22 at the time of refrigerant shortage need to be considered. Additionally, when there is a pressure loss between the discharge pressure sensor 34*b* and a refrigerant flow outlet of the first supercooler 22, it is necessary to consider a reduced amount of the saturation temperature due to the pressure loss. Therefore, while precision is slightly reduced compared with a case where the saturated liquid temperature is obtained from the pressure detected by the supercooler outlet pressure sensor 34*c*, the number of pressure sensors is reduced, so that it is possible to attain cost reduction.

As described above, according to the refrigeration apparatus 1 of Embodiment 2, the supercooler outlet pressure sensor 34*c* that detects the pressure at the same position as the supercooler outlet temperature sensor 33*d* is installed. Therefore, the degree SC of supercooling can be calculated on the basis of the liquid saturation temperature obtained from the pressure detected in the refrigerant flow outlet of the first supercooler 22, and the refrigerant amount determination process can be performed highly preciously regardless of the temperature gradient of the refrigerant.

Furthermore, in the refrigeration apparatus 1 of Embodiment 2, the temperature gradient of the refrigerant does not need to be considered, and therefore the heat source side control unit 31 can perform the refrigerant amount determination process in the same procedure regardless of the presence of the temperature gradient of the refrigerant. Therefore, it is possible to reduce a development load of program software performed by the heat source side control unit 31.

Embodiment 3

Figure 9:
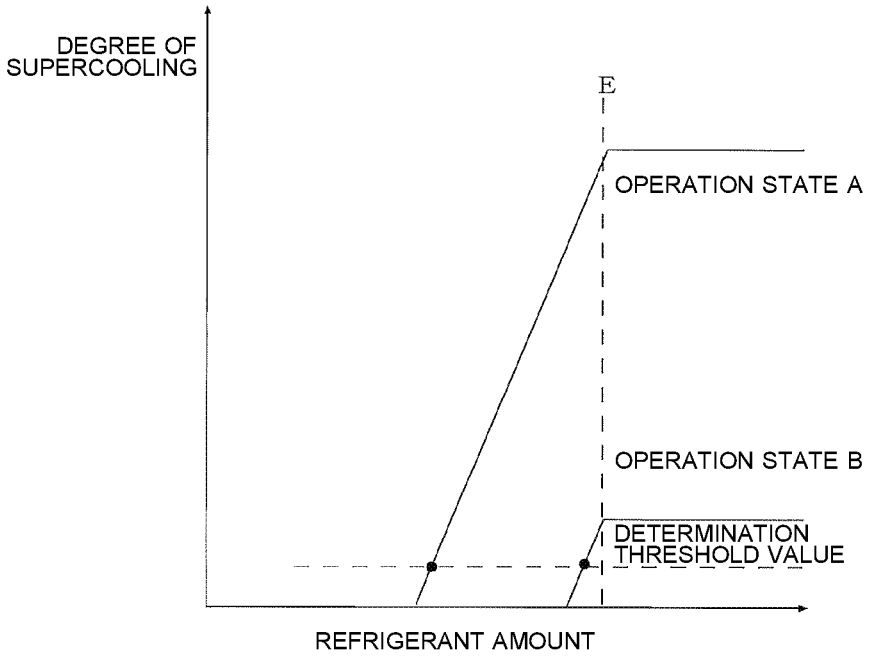
FIG. 9 is a diagram illustrating relation among a refrigerant amount in a refrigerant circuit 10 according to Embodiment 3 of the present invention, a degree SC of supercooling in a first supercooler 22, and an operating condition of a refrigeration apparatus 1.

FIG. 9 is a diagram illustrating relation among a refrigerant amount in a refrigerant circuit 10 according to Embodiment 3 of the present invention, a degree SC of supercooling in a first supercooler 22, and an operating condition of a refrigeration apparatus 1. As illustrated in FIG. 9, the degree SC of supercooling of the first supercooler 22 largely varies in accordance with the operating condition of the refrigeration apparatus 1 (such as an outdoor air temperature, a heat exchange amount, and a refrigerant circulation amount). Therefore, when a shortage of the refrigerant amount is determined by use of the degree SC of supercooling, it is necessary to set a supercooling degree threshold value S to be low not to perform erroneous determination. When the supercooling degree threshold value S is set to be low, it takes long time to determine the shortage of the refrigerant amount. Therefore, for example, when the refrigerant leaks, it takes time to determine the shortage, so that leakage amount of the refrigerant is increased.

[Determination of Refrigerant Amount]

In the refrigeration apparatus 1 of Embodiment 3, a refrigerant amount is determined by use of the temperature efficiency T of the first supercooler 22, the change of which to the change of an operating condition of the refrigeration apparatus 1 is smaller than the degree SC of supercooling. The temperature efficiency T indicates efficiency of the first supercooler 22 as described below. Herein, components of the refrigeration apparatus 1 in Embodiment 3 are the same as the components of the refrigeration apparatus 1 in FIG. 1.

Figure 10:
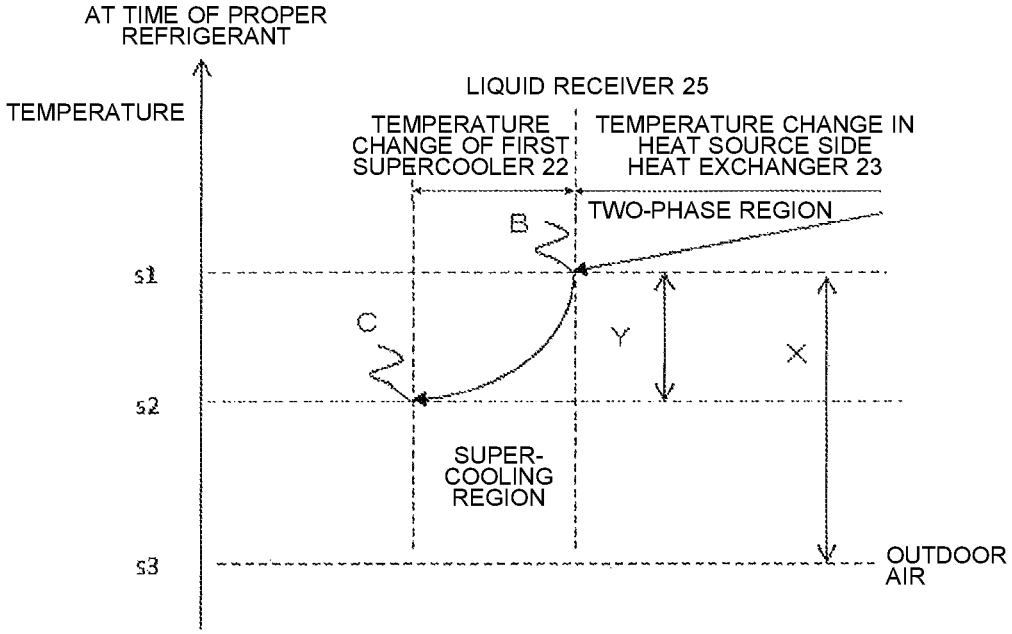
FIG. 10 is a diagram illustrating an example of temperature change of refrigerant in the refrigerant circuit 10 when the refrigerant amount is a proper amount in the refrigeration apparatus 1 according to Embodiment 3 of the present invention.

FIG. 10 is a diagram illustrating an example of temperature change of refrigerant in the refrigerant circuit 10 when the refrigerant amount is proper in the refrigeration apparatus 1 according to Embodiment 3 of the present invention. FIG. 10 illustrates the temperature change of refrigerant when the refrigerant flows in a heat source side heat exchanger 23, a liquid receiver 25, and the first supercooler 22. In FIG. 10, the vertical axis denotes a temperature. The temperature increases upward. The horizontal axis denotes a refrigerant route of the heat source side heat exchanger 23, the liquid receiver 25, and the first supercooler 22. s1 denotes the condensing temperature (saturated liquid temperature) of refrigerant. s2 denotes the refrigerant temperature in a refrigerant flow outlet of the first supercooler 22. s3 denotes an outdoor air temperature.

The temperature efficiency T of the first supercooler 22 indicates efficiency of the first supercooler 22, and is a numeral value expressed by using a maximum temperature difference X obtainable in the first supercooler 22 as a denominator, and using an actual temperature difference Y as a numerator. Therefore, the temperature efficiency T is a value obtained by dividing the actually obtainable temperature difference Y by the maximum temperature difference X, and is expressed by Expression (3) described below.

$$\text{Temperature Efficiency } T = \text{Actually Obtainable Temperature Difference } Y / \text{Maximum Temperature Difference } X \quad (3)$$

In the first supercooler 22, the maximum temperature difference X is a temperature difference between a condensing temperature s1 and an outdoor air temperature s3. An actually obtainable temperature difference B is a difference between the condensing temperature s1 and a temperature s2 on the outlet side of the first supercooler 22.

Figure 11:
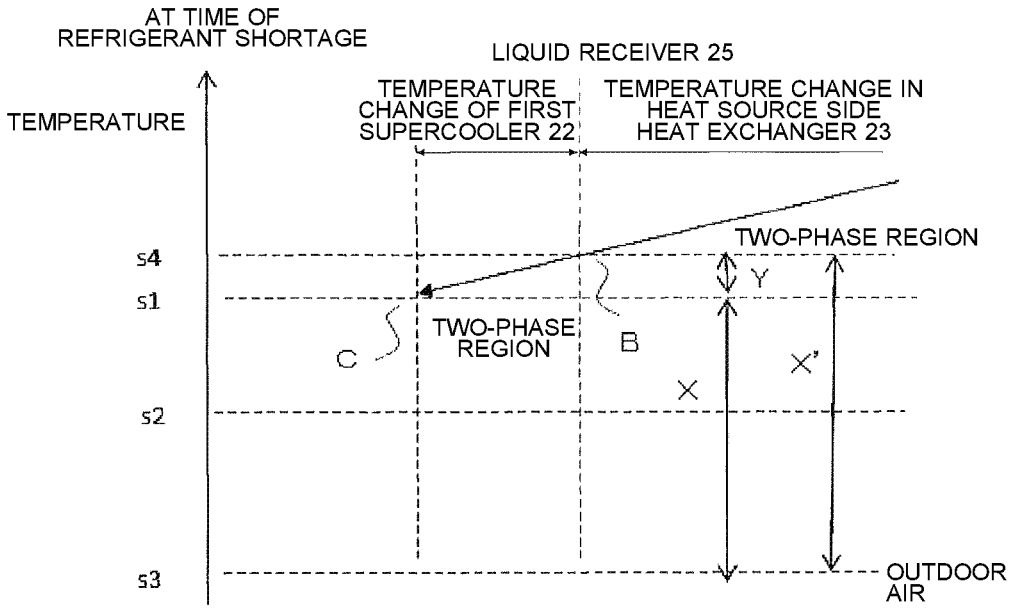
FIG. 11 is a diagram illustrating an example of temperature change of refrigerant in the refrigerant circuit 10 when there is a shortage of the refrigerant amount in the refrigeration apparatus 1 according to Embodiment 3 of the present invention.

FIG. 11 is a diagram illustrating an example of temperature change of refrigerant in the refrigerant circuit 10 when there is a shortage of the refrigerant amount in the refrigeration apparatus 1 according to Embodiment 3 of the present invention. FIG. 11 illustrates the temperature change of the refrigerant in a case of the refrigerant shortage 1 described in Embodiment 1. FIG. 11 illustrates a state in which the refrigerant is saturated liquid refrigerant of quality 0 at a position of a point C on the refrigerant flow outlet side of the first supercooler 22. The temperature difference Y is generated between the position of the point C and a position of a point B on the refrigerant flow outlet side of the liquid receiver 25 by temperature gradient. Therefore, when refrigerant having a large temperature gradient is used, the temperature efficiency T seems to be increased by the amount of temperature gradient compared to a case of refrigerant having no temperature gradient, at the time of the refrigerant shortage.

In a case where the refrigerant amount is determined by use of the temperature efficiency T, when the temperature efficiency T is smaller than a preset threshold value, the heat source side control unit 31 determines that there is a shortage of the refrigerant amount. Herein, for example, when refrigerant having a large temperature gradient is used, the threshold value is set to be larger than a value obtained by considering the amount of the temperature gradient obtained from the refrigerant flow outlet side of the liquid receiver 25 to the first supercooler 22. For example, the determination threshold value may be set to a value larger than a value obtained by dividing the temperature gradient of the refrigerant by the maximum temperature difference in the first supercooler 22.

Figure 12:
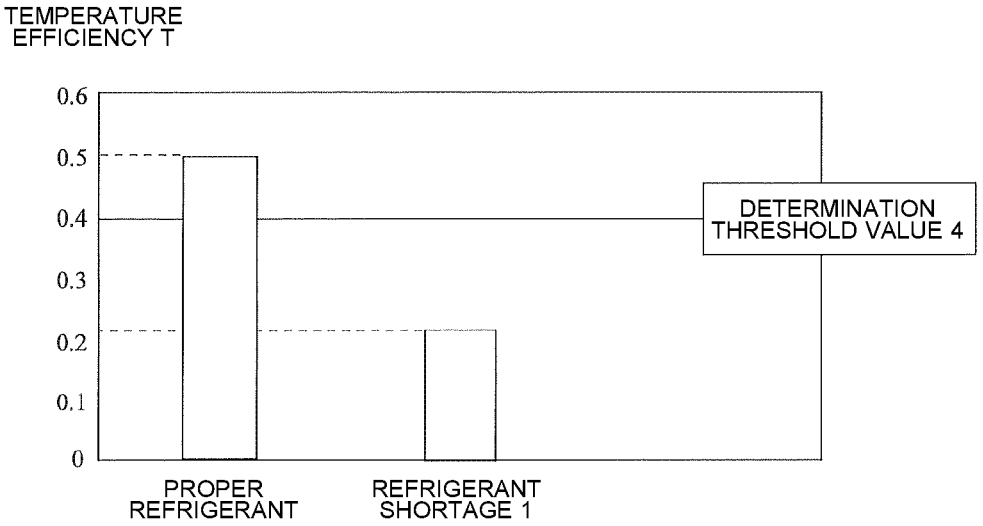
FIG. 12 is a diagram illustrating relation between the refrigerant in the refrigerant circuit 10 according to Embodiment 3 of the present invention, and temperature efficiency T.

FIG. 12 is a diagram illustrating relation between the refrigerant in the refrigerant circuit 10 according to Embodiment 3 of the present invention, and the temperature efficiency T. For example, in the example of FIG. 12, when the value of the maximum temperature difference X is set to 10 K, the threshold value is set to be larger than 0.23 (=3.0÷(10.0+3.0)). For example, in Embodiment 3, the threshold value is set to 0.4. The temperature efficiency T of the first supercooler 22 at the time of proper refrigerant needs to be designed to be larger than 0.23 described above. For example, in Embodiment 3, the temperature efficiency T is set to 0.5 (=5.0÷10.0).

Figure 13:
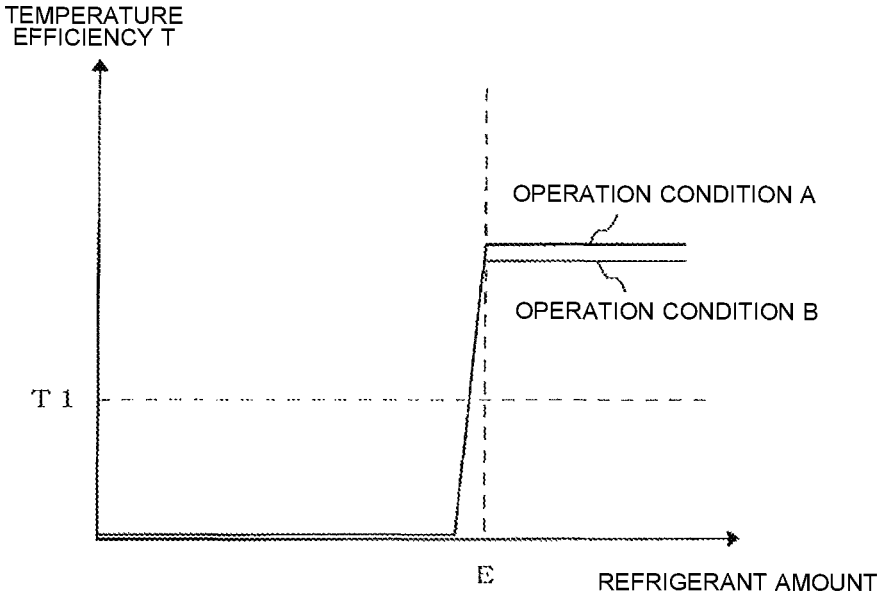
FIG. 13 is a diagram illustrating relation among the refrigerant amount in the refrigerant circuit 10 according to Embodiment 3 of the present invention, temperature efficiency T in the first supercooler 22, and an operating condition of the refrigeration apparatus 1.

FIG. 13 is a diagram illustrating relationship among the refrigerant amount in the refrigerant circuit 10 according to Embodiment 3 of the present invention, the temperature efficiency T in the first supercooler 22, and the operating condition of the refrigeration apparatus 1. In FIG. 13, the horizontal axis denotes the refrigerant amount of the refrigerant. The vertical axis denotes the temperature efficiency T of the first supercooler 22. As illustrated in FIG. 13, when the refrigerant amount is reduced, the refrigerant amount is E, and when the surplus liquid refrigerant in the liquid receiver 25 is run out, the temperature efficiency T of the first supercooler 22 is reduced. When determining that the temperature efficiency T is smaller than a preset temperature efficiency threshold value T1, the heat source side control unit 31 determines that the refrigerant leaks. The temperature efficiency T indicates performance of the first supercooler 22. The change of the temperature efficiency T by the operating condition of the refrigeration apparatus 1 is smaller than the change of the degree SC of supercooling by the operating condition of the refrigeration apparatus 1, and therefore it is possible to improve determination precision of the shortage of the refrigerant amount without setting the temperature efficiency threshold value T1 per operating condition of the refrigeration apparatus 1.

The flow of the refrigerant amount determination process in the refrigeration apparatus 1 according to Embodiment 3 is the same as that of the refrigerant amount determination process described on the basis of FIG. 7 in Embodiment 1. In Embodiment 3, the temperature efficiency T is calculated, and it is determined whether or not the refrigerant amount is proper by comparing the temperature efficiency T with a determination threshold value Tm, in place of the degree SC of supercooling.

As described above, in the refrigeration apparatus 1 of Embodiment 3, the heat source side control unit 31 calculates the temperature efficiency T, and performs the refrigerant amount determination process on the basis of the temperature efficiency T, the determination threshold value of the temperature efficiency T is made larger than a value obtained by considering a temperature gradient, and in the specification of the first supercooler 22, the temperature efficiency T at the time of the proper refrigerant amount is made larger than the temperature efficiency T by the temperature gradient at the time of refrigerant shortage, and therefore the time until the shortage of the refrigerant amount is determined can be made shorter than time when determining by the degree SC of supercooling. Therefore, it is possible to reduce the leakage amount of the refrigerant.

Embodiment 4

A refrigeration apparatus 1 of Embodiment 4 has a supercooler outlet pressure sensor 34*c* in place of the liquid receiver outlet temperature sensor 33*h* as in the case of the refrigeration apparatus 1 of Embodiment 2. Therefore, a configuration of the refrigeration apparatus 1 of Embodiment 4 is the same as the configuration in FIG. 8. The supercooler outlet pressure sensor 34*c* detects the pressure of refrigerant that passes through a first supercooler 22. The supercooler outlet pressure sensor 34*c* is installed to be able to detect the pressure of refrigerant at the same position as a supercooler outlet temperature sensor 33*d*.

In Embodiment 3 described above, the temperature efficiency T of the first supercooler 22 is calculated, for example, on the basis of the liquid receiver outlet temperature detected by the liquid receiver outlet temperature sensor 33*h*. In Embodiment 4, a saturated liquid temperature is obtained from pressure detected by the supercooler outlet pressure sensor 34*c*. Then, a difference between the saturated liquid temperature and a temperature detected by the supercooler outlet temperature sensor 33*d* is defined as the degree SC of supercooling, and the temperature efficiency T of the first supercooler 22 is calculated. The temperature efficiency T is obtained on the basis of the pressure and the temperature of the refrigerant at the same position, so that it is not necessary to consider the temperature gradient of the refrigerant.

Herein, a saturated liquid temperature at an installation position of the supercooler outlet temperature sensor 33*d* may be obtained on the basis of a saturated liquid temperature obtained from discharge pressure detected by the discharge pressure sensor 34*b*. Then, the difference between the saturated liquid temperature and the temperature detected by the supercooler outlet temperature sensor 33*d* is defined as the degree SC of supercooling. Therefore, the degree SC of supercooling and the temperature efficiency T can be obtained on the basis of the discharge pressure, and therefore it is possible to reduce the number of pressure sensors, and it is possible to attain cost reduction.

Herein, as to the saturation temperature of the pressure at the same position as the supercooler outlet temperature sensor 33*d*, the saturation temperature being obtained at this time, the saturated liquid temperature obtained from the discharge pressure detected by the discharge pressure sensor 34*b*, and a temperature gradient at the first supercooler 22 at the time of refrigerant shortage need to be considered. Additionally, when there is a pressure loss between the discharge pressure sensor 34*b* and a refrigerant flow outlet of the first supercooler 22, it is necessary to consider a reduced amount of the saturation temperature due to the pressure loss. Therefore, while precision is slightly deteriorated compared with a case where the saturated liquid temperature is obtained from the pressure detected by the supercooler outlet pressure sensor 34*c*, the number of pressure sensors is reduced, so that it is possible to attain cost reduction.

As described above, according to the refrigeration apparatus 1 of Embodiment 4, the supercooler outlet pressure sensor 34*c* that detects the pressure at the same position as the supercooler outlet temperature sensor 33*d* is installed. Therefore, the temperature efficiency T can be calculated on the basis of the liquid saturation temperature obtained from the pressure detected at the refrigerant flow outlet of the first supercooler 22, and the refrigerant amount determination process can be performed highly precisely regardless of the temperature gradient of the refrigerant.

Furthermore, in the refrigeration apparatus 1 of Embodiment 4, the temperature gradient of the refrigerant does not need to be considered, and therefore the heat source side control unit 31 can perform the refrigerant amount determination process in the same procedure regardless of the presence of the temperature gradient of the refrigerant. Therefore, it is possible to reduce a development load of program software performed by the heat source side control unit 31.

Embodiment 5

Figure 14:
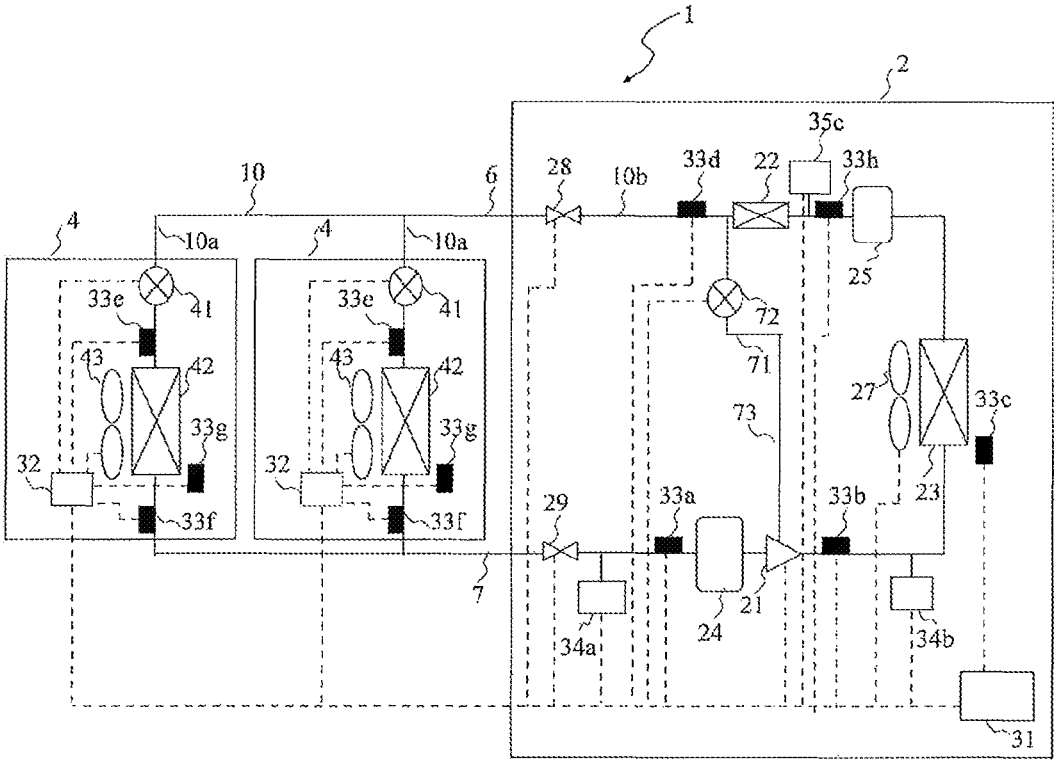
FIG. 14 is a diagram illustrating a configuration of a refrigeration apparatus 1 according to Embodiment 5 of the present invention.

FIG. 14 is a diagram illustrating a configuration of a refrigeration apparatus 1 according to Embodiment 5 of the present invention. In FIG. 14, apparatuses denoted by the same reference numerals as the apparatuses in FIG. 1 and FIG. 8 perform operation similar to the operation described in Embodiment 1 and Embodiment 2.

In the refrigeration apparatus 1 of Embodiment 5, a pressure sensor 35*c* is installed between a heat source side heat exchanger 23 and a first supercooler 22. In Embodiment 5, the position is the same as the installation position of a liquid receiver outlet temperature sensor 33*h* installed at a refrigerant flow outlet of the liquid receiver 25. A heat source side control unit 31 determines refrigerant composition change at the time of refrigerant shortage with a temperature difference Z ($=\alpha-\beta$) between a detection temperature $\alpha$ by the liquid receiver outlet temperature sensor 33*h*, and a saturated liquid temperature $\beta$ based on detection pressure by the pressure sensor 35*c* as an index. Therefore, the heat source side control unit 31 according to Embodiment 5 functions as a composition change determination unit.

After the refrigerant shortage of a refrigerant circuit 10 is determined by the process in Embodiment 1 to Embodiment 4 or other process, when the refrigerant composition change does not occur, a temperature gradient is increased. For example, as illustrated in FIG. 3, when a proper amount of the refrigerant is sealed, the detection temperature in the liquid receiver outlet temperature sensor 33*h* is a temperature (32 [degrees C.]) at a point B. On the other hand, the saturated liquid temperature based on the detection pressure in the pressure sensor 35*c* also is 32 [degrees C.]. Therefore, the temperature difference Z is 0 [degrees C.] as expressed by Expression (4) as described below.

$$\text{Temperature Difference } Z=\alpha-\beta=32-32 \text{ [degrees C.]}=0 \text{ [degrees C.]} \quad (4)$$

On the other hand, when refrigerant leakage proceeds to the state of the refrigerant shortage 1 illustrated in FIG. 4, the detection temperature in the liquid receiver outlet temperature sensor 33*h* is a temperature (35 [degrees C.]) at the point B. On the other hand, the saturated liquid temperature based on the detection pressure in the pressure sensor 35*c* is 32 [degrees C.] and does not change. Therefore, the temperature difference Z is 3 [degrees C.] as expressed by Expression (5) described below.

$$\text{Temperature Difference } Z=\alpha-\beta=35-32 \text{ [degrees C.]}=3 \text{ [degrees C.]} \quad (5)$$

Furthermore, when refrigerant leakage proceeds to the state of the refrigerant shortage 2 illustrated in FIG. 5, the detection temperature in the liquid receiver outlet temperature sensor 33*h* is a temperature (37 [degrees C.]) at the point B. On the other hand, the saturated liquid temperature based on the detection pressure in the pressure sensor 35*c* is 32 [degrees C.] and does not change. Therefore, the temperature difference Z is 5 [degrees C.] as expressed by Expression (6) described below.

$$\text{Temperature Difference } Z=\alpha-\beta=37-32 \text{ [degrees C.]}=5 \text{ [degrees C.]} \quad (6)$$

As described above, when refrigerant leaks from the refrigerant circuit 10, and the refrigerant composition change does not occur, the temperature difference Z is generated between the detection temperature α in the liquid receiver outlet temperature sensor 33*h* and the saturated liquid temperature β based on the detection pressure in the pressure sensor 35*c*. The heat source side control unit 31 can determine refrigerant leakage by the temperature difference Z.

For example, it is assumed that the aforementioned mixed refrigerant of R32, R125, R134a, R1234yf and $CO_2$ satisfying six conditions, or mixed refrigerant that generates a temperature gradient such as R407C, R448A, or R449A is sealed in the refrigerant circuit. When mixed refrigerant in a two-phase gas-liquid state leaks from the refrigerant circuit 10, deviation occurs in respective leakage amounts of ingredients, and composition is often largely changed. When such composition change occurs, a large temperature difference due to the temperature gradient is not generated.

In Embodiment 5, the heat source side control unit 31 determines the refrigerant shortage by the method of Embodiment 1 to Embodiment 4 or other method, and determines whether or not composition change occurs due to refrigerant leakage, from the temperature difference Z. Herein, even when the refrigerant leakage occurs in a gas single phase region or a liquid single phase region, composition change hardly occurs. In such a case, the heat source side control unit 31 can perform a process of determining the refrigerant shortage only by the temperature difference Z.

When the composition change of the mixed refrigerant is generated, whole refrigerant in the refrigerant circuit needs to be collected, and be replaced. This is because when the composition change is generated, deviation occurs between the saturation pressure and the saturation temperature of the refrigerant, and a situation of the refrigerant circuit 10 cannot be correctly recognized. On the other hand, when the composition change is not generated, the whole refrigerant is not collected, and refrigerant only needs to be additionally filled. When the refrigerant composition change can be determined, it is possible to prevent unnecessary collection of whole refrigerant, and addition of whole refrigerant, and to save refrigerant.

As described above, according to the refrigeration apparatus 1 of Embodiment 5, the heat source side control unit 31 calculates the temperature difference Z between the detection temperature α by the liquid receiver outlet temperature sensor 33*h* and the saturated liquid temperature β based on the detection pressure by the pressure sensor 35*c*. Therefore, in the case of refrigerant shortage, the temperature difference Z is used, so that it is possible to determine the presence of composition change, and it is possible to correctly detect a situation of the pressure and the temperature of the refrigerant circuit 10. Therefore, it is possible to more efficiently control the refrigeration apparatus 1. The presence of composition change is determined, so that it is also possible to determine whether or not collection of whole refrigerant is required, when the refrigerant leakage is generated.

The pressure sensor 35*c* may not be installed, and the heat source side control unit 31 may calculate (estimate) saturation temperature obtained by considering the temperature gradient and the pressure loss of the condenser from the detection pressure by a discharge pressure sensor 34*b*. The heat source side control unit 31 may determine the presence of composition change, by the temperature difference between the saturation temperature, and the detection temperature by the liquid receiver outlet temperature sensor 33*h*.

Embodiment 6

Figure 15:
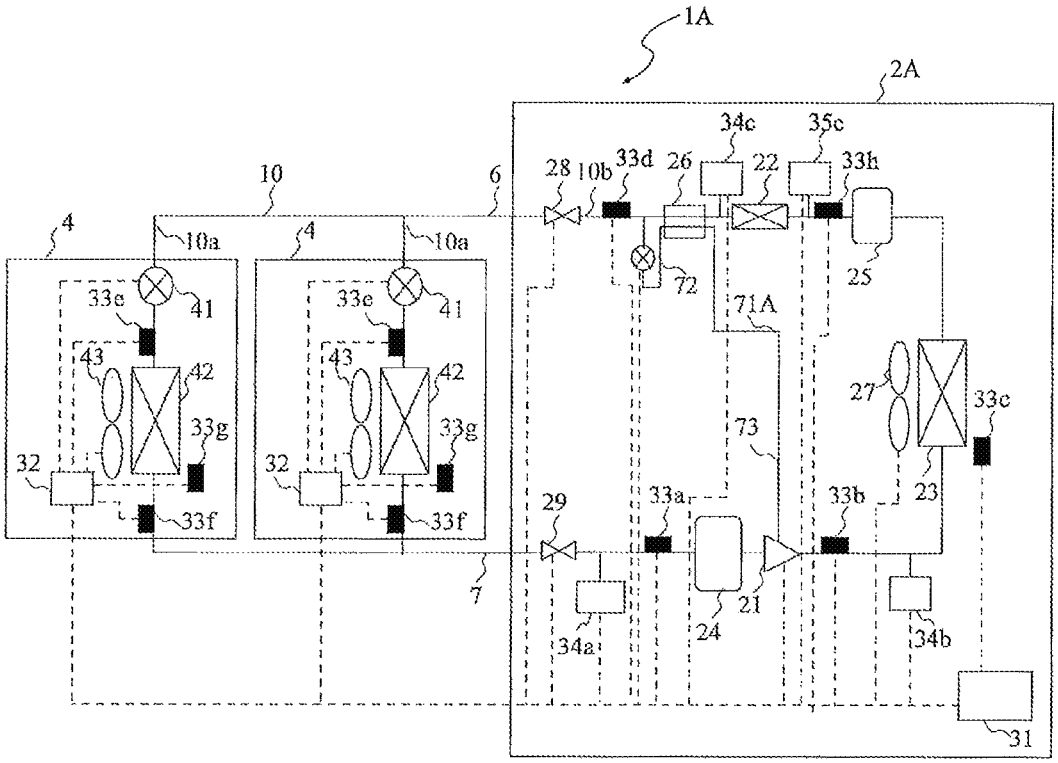
FIG. 15 is a diagram illustrating a configuration of a refrigeration apparatus 1 according to Embodiment 6 of the present invention.

FIG. 15 is a diagram illustrating a configuration of a refrigeration apparatus 1 according to Embodiment 6 of the present invention. In FIG. 15, apparatuses denoted by the same reference numerals as the apparatuses in FIG. 1 and FIG. 8 perform operation similar to the operation described in Embodiment 1 and Embodiment 2

As illustrated in FIG. 15, in a refrigeration apparatus 1A in Embodiment 6, a heat source side unit 2A further has a second supercooler 26. The second supercooler 26 is installed on a downstream side of a first supercooler 22 in flow of refrigerant. Herein, the second supercooler 26 is equivalent to a "supercooler" in the present invention. The second supercooler 26 includes, for example, a double pipe or a plate heat exchanger. The second supercooler 26 is a refrigerant-to-refrigerant heat exchanger that exchanges heat between high pressure refrigerant flowing in a heat source side refrigerant circuit 10*b*, and middle pressure refrigerant that flows in a first injection flow passage 71A.

A part of refrigerant that passes through the second supercooler 26 is expanded by an injection amount regulating valve 72 to be middle pressure refrigerant. Then, the middle pressure refrigerant exchanges heat with the refrigerant that passes through the second supercooler 26. As a result, high pressure refrigerant that flows out of the first supercooler 22, and is heat-exchanged by the second supercooler 26 is further supercooled. The middle pressure refrigerant that flows in from the injection amount regulating valve 72, and is heat-exchanged by the second supercooler 26 turns to be refrigerant having high quality, and is injected into a middle pressure port of a compressor 21 to reduce the discharge temperature of the compressor 21.

In the refrigeration apparatus 1A of Embodiment 6, a refrigerant determination process performed by a heat source side control unit 31 can be performed by use of the degree SC of supercooling of the first supercooler 22, or temperature efficiency T. The heat source side control unit 31 may perform the refrigerant determination process by use of the degree SC of supercooling of the second supercooler 26, or the temperature efficiency T. Furthermore, the heat source side control unit 31 may perform the refrigerant determination process by use of both the degree SC of supercooling of the first supercooler 22 and the degree SC of supercooling of the second supercooler 26, or the temperature efficiency T. Herein, in the refrigeration apparatus 1A of Embodiment 6, the first supercooler 22 may not be installed, and the refrigeration apparatus 1A may be configured to allow the refrigerant that flows out of the liquid receiver 25 to flow into the second supercooler 26. The temperature efficiency T at this time is Temperature Efficiency T=Actually Obtainable Temperature Difference Y/Maximum Temperature Difference=(Detection Temperature by Liquid Receiver Outlet Temperature Sensor 33*h*−Detection Temperature by Supercooler Outlet Temperature Sensor 33*d*)/(Detection Temperature by Liquid Receiver Outlet Temperature Sensor 33*h*−Middle Pressure Saturation Temperature on Downstream Side of Injection Amount Regulating Valve 72).

INDUSTRIAL APPLICABILITY

In Embodiment 1 to Embodiment 6 described above, the refrigeration apparatus 1 and the refrigeration apparatus 1A are described as examples of a refrigeration cycle apparatus. However, this is not restrictive. For example, the present invention can be applied to an air-conditioning device, a refrigeration apparatus, or other refrigeration cycle apparatus.

In Embodiment 1 to Embodiment 6 described above, description is made assuming that the refrigerant used in the refrigeration cycle apparatus is refrigerant having a large temperature gradient. However, the configurations of Embodiment 1 to Embodiment 6 can be applied also to refrigerant having a small temperature gradient or having no temperature gradient.

REFERENCE SIGNS LIST

1, 1A refrigeration apparatus 2, 2A heat source side unit 3 control unit

3*a* acquisition unit 3*b* arithmetic unit 3*c* storage unit 3*d* drive unit

3*e* input unit 3*f* output unit 4 use side unit 6 liquid refrigerant extension pipe 7 gas refrigerant extension pipe 10 refrigerant circuit

10*a* use side refrigerant circuit 10*b* heat source side refrigerant circuit 21 compressor 22 first supercooler 23 heat source side heat exchanger 24 accumulator 25 liquid receiver 26 second supercooler 27 heat source side fan 28 liquid side shut-off valve 29 gas side shut-off valve 31 heat source side control unit 32 use side control unit 33*a* suction temperature sensor 33*b* discharge temperature sensor 33*c* suction outdoor air temperature sensor 33*d* supercooler outlet temperature sensor 33*e* use side heat exchange inlet temperature sensor 33*f* use side heat exchange outlet temperature sensor

33*g* suction air temperature sensor 33*h* liquid receiver outlet temperature sensor 34*a* suction pressure sensor 34*b* discharge pressure sensor

34*c* supercooler outlet pressure sensor 35*c* pressure sensor 41 use side expansion valve 42 use side heat exchanger 43 use side fan 71, 71A first injection flow passage 72 injection amount regulating valve 73 injection pipe

The invention claimed is:

1. A refrigeration cycle apparatus comprising a controller having a microcomputer, and a refrigerant circuit in which a compressor, a condenser, a supercooler, an expansion valve, and an evaporator are connected by a refrigerant pipe, and configured to circulate refrigerant having a temperature gradient, wherein:

the controller controls the refrigerant circuit such that a degree of supercooling of the refrigerant is larger than the temperature gradient generated at a time of refrigerant shortage of the refrigerant between the refrigerant flow inlet and the refrigerant flow outlet of the supercooler, the degree of supercooling being a temperature difference between a temperature from the condenser to a refrigerant flow inlet of the supercooler and a temperature in a refrigerant flow outlet on a downstream side of the supercooler, the controller is further configured to compare a determination threshold value set to a value larger than the temperature gradient of the refrigerant with the degree of supercooling of the refrigerant, and determine whether or not there is a shortage of a refrigerant amount filled in the refrigerant circuit, the temperature gradient of the refrigerant is a difference between a saturated gas temperature and a saturated liquid temperature of the refrigerant at the same pressure, the refrigeration cycle apparatus further comprises a remote control, the determination threshold value is set based on an instruction sent from the remote control, the refrigeration cycle apparatus further comprises a supercooler inlet temperature sensor installed in the refrigerant flow inlet of the supercooler, and configured to detect a temperature, and a supercooler outlet temperature sensor installed in the refrigerant flow outlet of the supercooler, and configured to detect a temperature, and the controller determines whether or not there is a shortage of the refrigerant amount based on a degree of supercooling by a temperature difference between a temperature detected by the supercooler inlet temperature sensor and a temperature detected by the supercooler outlet temperature sensor.

2. The refrigeration cycle apparatus of claim 1, further comprising:

a supercooler outlet pressure sensor installed in the refrigerant flow outlet of the supercooler, and configured to detect a pressure, wherein the controller determines whether or not there is a shortage of the refrigerant amount based on a degree of supercooling by a temperature difference between a saturation temperature obtained from pressure detected by the supercooler outlet pressure sensor, and a temperature detected by the supercooler outlet temperature sensor.

3. The refrigeration cycle apparatus of claim 1, further comprising:

a pressure sensor installed between the condenser and the supercooler, and configured to detect a pressure;

a temperature sensor installed between the condenser and the supercooler, and configured to detect a temperature; and the controller is further configured to determine presence of composition change of the refrigerant, by a temperature difference between a saturation temperature obtained from pressure detected by the pressure sensor, and a temperature detected by the temperature sensor, when the controller determines that there is a shortage of the refrigerant amount.

4. The refrigeration cycle apparatus of claim 1, wherein the refrigerant is mixed refrigerant of R32, R125, R134a, R1234yf, and $CO_2$, and satisfies all of:

a condition that a ratio XR32 (wt %) of weight of R32 to total weight of the mixed refrigerant is $33<XR32<39$;

a condition that a ratio XR125 (wt %) of weight of R125 to total weight of the mixed refrigerant is $27<XR125<33$;

a condition that a ratio XR134a (wt %) of weight of R134a to total weight of the mixed refrigerant is $11<XR134a<17$;

a condition that a ratio XR1234yf (wt %) of weight of R1234yf to total weight of the mixed refrigerant is $11<XR1234y<17$;

a condition that a ratio $XCO_2$ (wt %) of weight of $CO_2$ to total weight of the mixed refrigerant is $3<XCO_2<9$; and a condition that a total sum of the XR32, the XR125, the XR134a, the XR1234yf and the $XCO_2$ is 100.

5. A refrigeration apparatus comprising the refrigeration cycle apparatus of claim 1.

* * * * *